US006644753B2

(12) United States Patent
Mraz

(10) Patent No.: US 6,644,753 B2
(45) Date of Patent: Nov. 11, 2003

(54) METHOD AND APPARATUS FOR REMOTE SELF-PROPELLED CONVEYING IN MINERAL DEPOSITS

(75) Inventor: Dennis Mraz, Saskatoon (CA)

(73) Assignee: DM Technologies Ltd., Saskatoon (CA)

( * ) Notice: Subject to any disclaimer, the term of this patent is extended or adjusted under 35 U.S.C. 154(b) by 0 days.

(21) Appl. No.: 10/107,442

(22) Filed: Mar. 28, 2002

(65) Prior Publication Data

US 2002/0125760 A1 Sep. 12, 2002

Related U.S. Application Data

(60) Division of application No. 09/734,665, filed on Dec. 13, 2000, which is a continuation-in-part of application No. 09/250,689, filed on Feb. 16, 1999, now Pat. No. 6,220,670.

(51) Int. Cl.[7] ..... E21C 35/08

(52) U.S. Cl. ..... 299/1.4; 299/1.9; 299/30; 299/31

(58) Field of Search ..... 299/1.05, 1.4, 299/1.7, 1.9, 10, 30, 31

(56) References Cited

U.S. PATENT DOCUMENTS

| | | | | | |
|---|---|---|---|---|---|
| 2,826,402 | A | | 3/1958 | Alspaugh et al. | 299/30 |
| 3,456,982 | A | | 7/1969 | Reilly | 299/30 |
| 3,497,055 | A | | 2/1970 | Oslakovic et al. | 299/30 |
| 3,603,264 | A | | 9/1971 | Arx | 104/138.2 |
| 3,963,080 | A | * | 6/1976 | Walker | 175/94 |
| 4,172,615 | A | | 10/1979 | Hakes | 299/30 |
| 4,192,551 | A | | 3/1980 | Weimer et al. | 299/30 |
| 4,226,476 | A | | 10/1980 | Fairchild et al. | 299/31 |
| 4,365,927 | A | | 12/1982 | Schenck | 414/729 |
| 4,390,211 | A | | 6/1983 | Thompson | 299/64 |
| 4,583,700 | A | | 4/1986 | Tschurbanoff | 191/12.2 R |
| 4,784,257 | A | | 11/1988 | Doerr | 198/303 |
| 4,846,320 | A | | 7/1989 | Clarke | 191/12 R |
| 4,869,358 | A | | 9/1989 | Chandler | 299/31 |
| 4,884,847 | A | * | 12/1989 | Bessinger et al. | 175/40 |
| 5,112,111 | A | | 5/1992 | Addington et al. | 299/18 |
| 5,232,269 | A | | 8/1993 | Addington et al. | 299/67 |
| 5,246,274 | A | | 9/1993 | Smith et al. | 299/64 |
| 5,261,729 | A | | 11/1993 | Addington et al. | 299/64 |
| 5,582,465 | A | | 12/1996 | Mraz | |
| 5,609,397 | A | | 3/1997 | Marshall et al. | 299/67 |
| 5,667,279 | A | * | 9/1997 | Christopher et al. | 299/1.9 |
| 5,692,807 | A | | 12/1997 | Zimmerman | 299/67 |
| 5,810,447 | A | | 9/1998 | Christopher et al. | 299/30 |
| 5,938,289 | A | | 8/1999 | Antoline et al. | 299/67 |

FOREIGN PATENT DOCUMENTS

| | | | | |
|---|---|---|---|---|
| SU | 612018 | * | 6/1978 | |
| SU | 1347573 | | 5/1988 | 299/64 |

OTHER PUBLICATIONS

Hartman, H. Senior Ed. "SME Mining Engineering Handbook" 1992, p. 1648.
Honeywell "A Revolution in Automated Mining".
Honeywell Modular Azimuth Position System (MAPS) Series.

* cited by examiner

*Primary Examiner*—Heather Shackelford
*Assistant Examiner*—John Kreck
(74) *Attorney, Agent, or Firm*—Swidler Berlin Shereff Friedman, LLP

(57) ABSTRACT

A method and apparatus for the mining of material from a seam includes a mining apparatus and a self-propelled conveyor capable of advancing or retreating in the seam on its own power and an advancing and steering arrangement for the mining apparatus. The self-propelled conveyor, electric cables and other services for the mining apparatus are protected against roof falls. The power input for the self-propelled conveyor is provided by continuous drive shafts powered at either one or both ends of the conveyor. Alternately, a unique reciprocating conveyor mechanically powered at either one or both ends of the conveyor is provided for conveying of aggregate material. An apparatus for assembling the conveyor and receiving aggregate material is provided at the rear end of the conveyor. A method and apparatus for accurately and precisely navigating the mining machine is disclosed.

10 Claims, 29 Drawing Sheets

METHOD AND APPARATUS FOR REMOTE SELF-PROPELLED CONVEYING IN MINERAL DEPOSITS

This application is a divisional of U.S. patent application Ser. No. 09/734,665, filed Dec. 13, 2000, which is a Continuation-In-Part of U.S. patent application Ser. No. 09/250,689, filed Feb. 16, 1999, now U.S. Pat. No. 6,220,670.

FIELD OF THE INVENTION

The present invention relates generally to mining and specifically to conveying in remote mining of bedded mineral deposits.

BACKGROUND OF THE INVENTION

Known methods of remote mining in bedded mineral deposits such as coal seams employ a mining machine that excavates mine openings to some distance from the seam exposure on the surface and means of conveying are required to transport the excavated material to the surface. In most of the present systems, conveying machines consisting of multiple conveyors are advanced into the mine openings from the surface. For example, U.S. Pat. Nos. 5,112,111, 5,232,269 and 5,261,729 to Addington at al. disclose an assembly of conveyors and a mining machine advanced into the seam without interrupting the flow of aggregate material by separate means designed to pull at the forward end and push at the rearward end. Similarly, U.S. Pat. No. 5,609,397 to Marshall at al. discloses an assembly of conveyors interconnected with a mining machine and a driving device located outside the seam and consisting of rack and pinion or, alternately, reciprocating cylinders, linear tracks, linear or rotary drives, chains, cables or other mechanical devices. The U.S. Pat. No. 5,692,807 to Zimmerman discloses a guidance assembly for extending and retracting an assembly of conveyors in and out of the seam. The U.S. Pat. No. 3,497,055 to Oslakovic at al. discloses a multi-unit train of conveyors having a self-propelled unit at each end coupled to intermediate units, each end unit being capable of towing the intermediate units. The U.S. Pat. No. 2,826,402 to Alspaugh at al. discloses a train of wheeled conveyor sections pulled into the mine opening and pushed out of it by a self-propelled mining machine. Buckling of the train is avoided by the grooves made by the mining machine in the floor, said grooves spaced the same distance as the treads of the wheels carrying the conveyor sections.

At present, as the interconnected combination of the mining machine and a conveying assembly comprising a plurality of conveyors is advanced some distance into the seam from a launch vehicle located on the outside, the axial force within the combination becomes excessive with respect to its length and the combination becomes less rigid. As a consequence, it becomes difficult to steer the mining machine located at the front of the combination and the conveying assembly itself can become unstable, which limits the penetration depth of mining. Furthermore, pulling the conveying assembly at the rearward end when it becomes entrapped by a rock fall may sometimes cause the conveying assembly to brake. It would therefore be desirable to provide for advancing and withdrawing the conveying assembly while minimizing the axial force within the conveying assembly.

Where the conveying assembly consists of a plurality of conveyor units, each of the individual conveyors requires a separate input of electric power which, in turn, requires coupling and uncoupling of electrical cables as the assembly is advanced into or retracted from the mine opening. It would be therefore desirable to provide a power input that does not require electric power at each individual conveyor of the assembly.

If the electric power input is not provided at each individual conveyor, the conveying assembly cannot be extended without interruption, as claimed in the U.S. Pat. No. 5,112,111 to Addington at al. It would therefore be desirable to provide for extending the conveying assembly while minimizing the time required for such extension of the machine.

Where open conveyors are used, they are prone to damage by falls of rock from unsupported roof. Often, when rock falls occur, mining must be interrupted and the conveying assembly brought to the surface in order to remove fallen rock from the machine and to repair damage. It would therefore be desirable to provide a conveying assembly that is enclosed in a protective enclosure and that is capable of withstanding at least moderate rock falls.

Electric cables, control cables and hoses for the remote mining machine that lay atop the conveying assembly are also prone to damage by rock falls. It would therefore be desirable to provide protective enclosures for cables, hoses and other services provided for the remote mining machine.

A remote mining machine located at the forward end of the conveying assembly may become entrapped by fallen rock and the traction force of the conveying assembly may not be sufficient to extract the mining machine. It would therefore be desirable to provide independent means of extracting the mining machine from the seam.

One type of mining for which the present invention is intended to be used is highwall mining. With highwall mining, the mining machine penetrates a substantially vertical face containing a seam. The mining machine digs into the face substantially perpendicularly thereto. To ensure the structural integrity of the mine is maintained, pillars of unmined material are left between the holes dug by the mining machine. These pillars support the roof and are therefore essential to avoiding a rock fall. Those of ordinary skill in the art will understand that in order to maintain minimum acceptable pillar thickness, it is desirable to dig exactly perpendicularly to the face. Any angular deviation by the mining machine as it travels requires an increased initial pillar width, which decreases the amount of material that can be removed from the mine. Therefore it is desirable to maintain accurate and precise knowledge of where the mining machine is located. Likewise, it is desirable to navigate the mining machine precisely and accurately to a desired location. In this manner, the operator can ensure that the desired mining path is followed.

One known method of determining mining machine position employs a system of gyros and accelerometers to estimate the distance traveled by the mining machine. This type of known method uses complicated software that requires several minutes to initiate during which the mining machine cannot be moved. The method also requires periodic re-calibration during use, which also requires the mining machine be at rest. Furthermore, this system is expensive, costing more than $100,000. Thus, what is needed is a cost-efficient mining machine that can accurately and precisely determine the position of the mining machine head.

SUMMARY OF THE INVENTION

Accordingly, it is an object of the present invention to provide a method and apparatus for advancing a remote conveying assembly without causing excessive axial forces within the assembly, by providing tractive forces at multiple locations along the length of the assembly.

Another object of the present invention is to provide a method and apparatus for remote conveying that does not require electric power at each conveying section of the conveying assembly.

Another object of the present invention is to provide a method and apparatus for extending the conveying assembly that minimizes the time required for extensions.

Another object of the present invention is to provide a method and apparatus for protecting the remote conveying assembly, electric cables and other services from damage by rock falls.

Another object of the present invention is to provide a method and apparatus for advancing and steering the remote mining machine independently of advancing the conveying assembly.

Another object of the present invention is to provide a method and apparatus for accurately and precisely determining the position of the mining machine within the seam.

These and other objects of the present invention will become clear from the detailed description of the invention, the drawings, and the claims included below.

BRIEF DESCRIPTION OF THE DRAWINGS

The present invention is described with reference to the accompanying drawings, in which like reference characters reference like elements, and wherein.

DETAILED DESCRIPTION OF THE PREFERRED EMBODIMENTS

Figure 1:
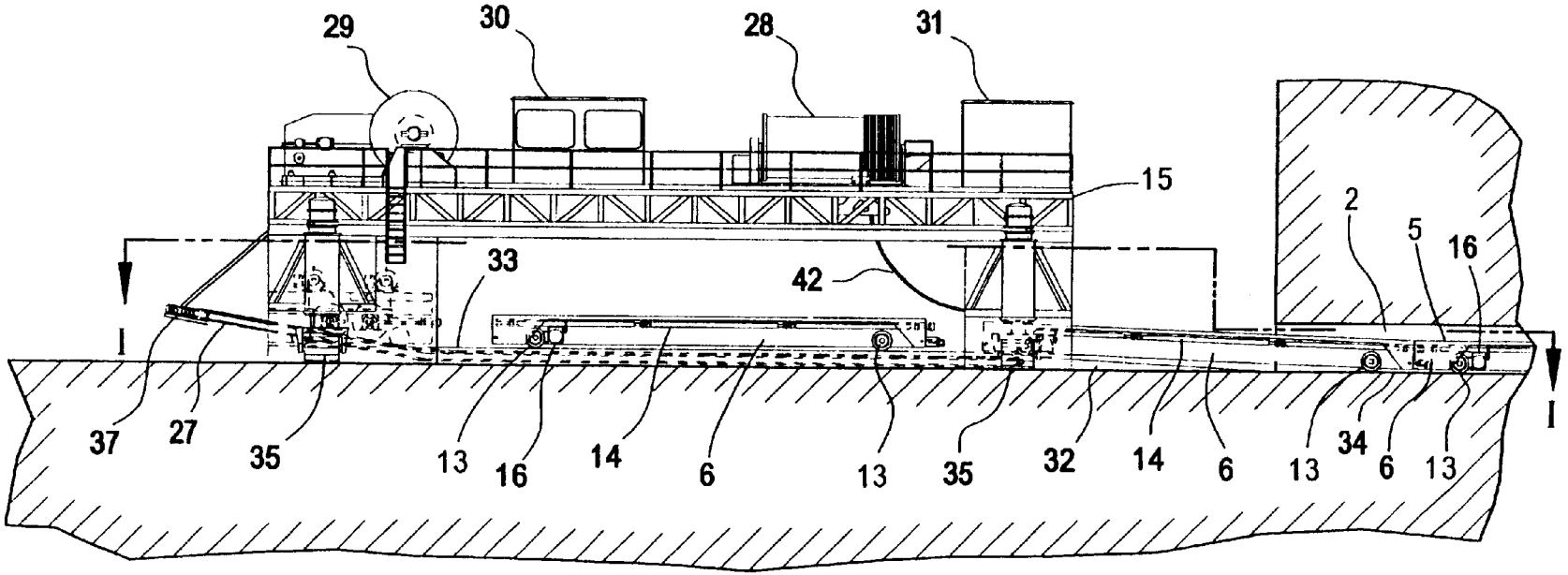
FIG. 1 is a schematic side view of the first part of the preferred embodiment of the present invention located outside the seam, including a mining platform, stacker and a rearward end of the conveying assembly.

Referring to FIGS. 1 through 8, a remote mining machine 1 excavates material in the mine opening 2 within a seam 3. Opening 2 could also be a tunnel opening. The mining machine 1 discharges the excavated material onto the receiving module 4 of the self-propelled conveying assembly 5. The self-propelled conveying assembly 5 consists of the receiving module 4, a plurality of intermediate modules 6 and a drive module 7. The mining machine 1 is connected to the receiving module 4 with extenders 12, shown in the drawings as advancing cylinders, which are used to advance the mining machine 1 into the mining room 2 and also to directionally steer it. Advancing cylinders 12 can steer the mining machine 1 by extending in different amounts or at different rates on either side of the mining machine 1. The receiving module 4 also carries braces 8. Bracers 8 typically take the form of side jacks and are normally used for steering the receiving module 4 within the mine opening 2. However, if the mining machine 1 is trapped by a rock fall, the side jacks 8 are braced between the walls 9 of the mine opening 2 and cylinders 12 are used to extract the mining machine 1 from under the rock fall. Alternatively, the jacks 8 can be braced between the roof and floor of the mine opening 2. Where necessary, the receiving module 4 carries a feeder 10 and a breaker 11.

Figure 3:
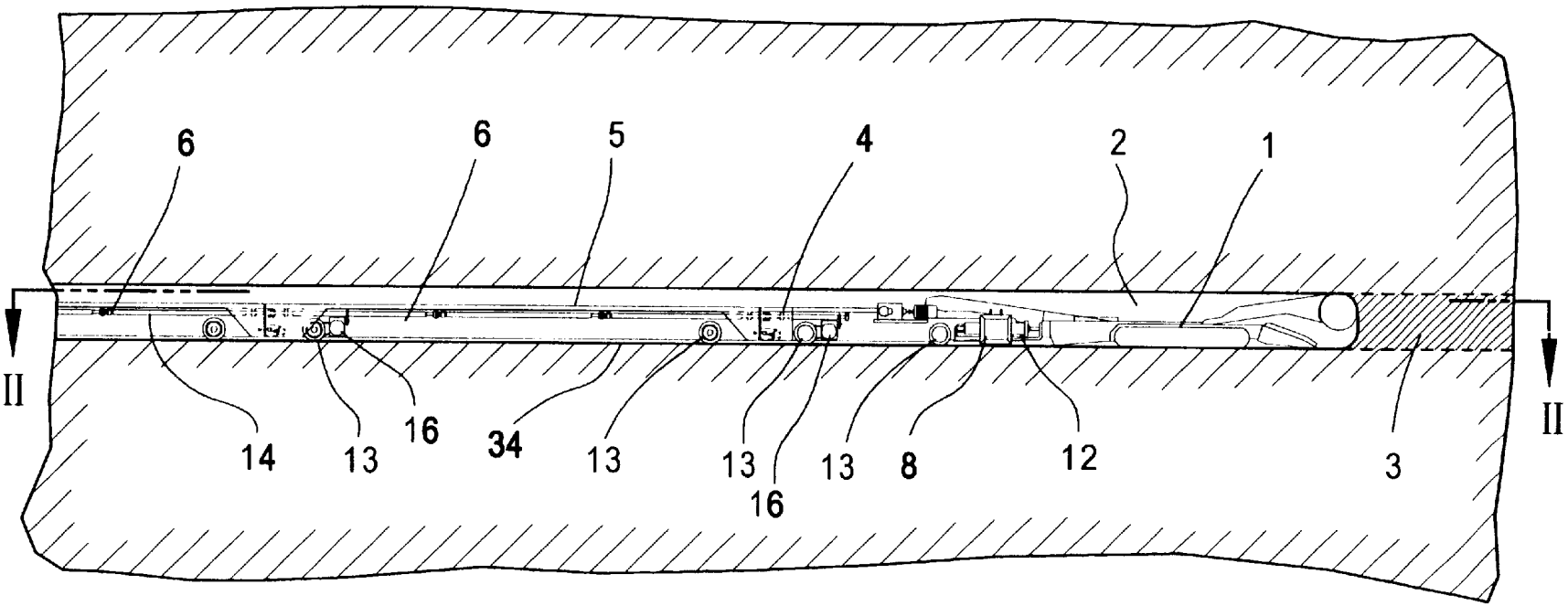
FIG. 3 is a schematic side view of the second part of the preferred embodiment of the present invention, located inside the seam, including a forward end of the conveying assembly, feeder/breaker, extender, bracer and a mining machine.
Figure 3A:
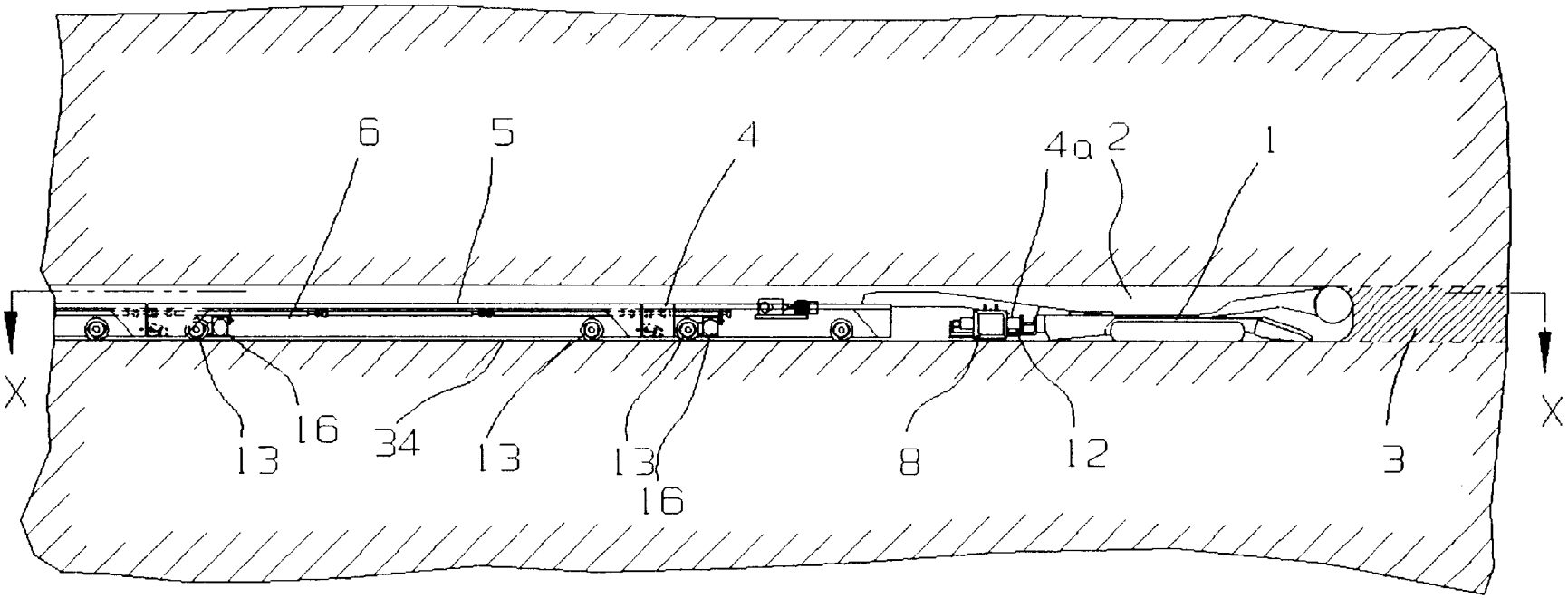
FIG. 3A is a schematic side view of the second part of the preferred embodiment of the present invention, showing the bracer and the extender located on a separate advancing machine independent of the receiving module.
Figure 4:
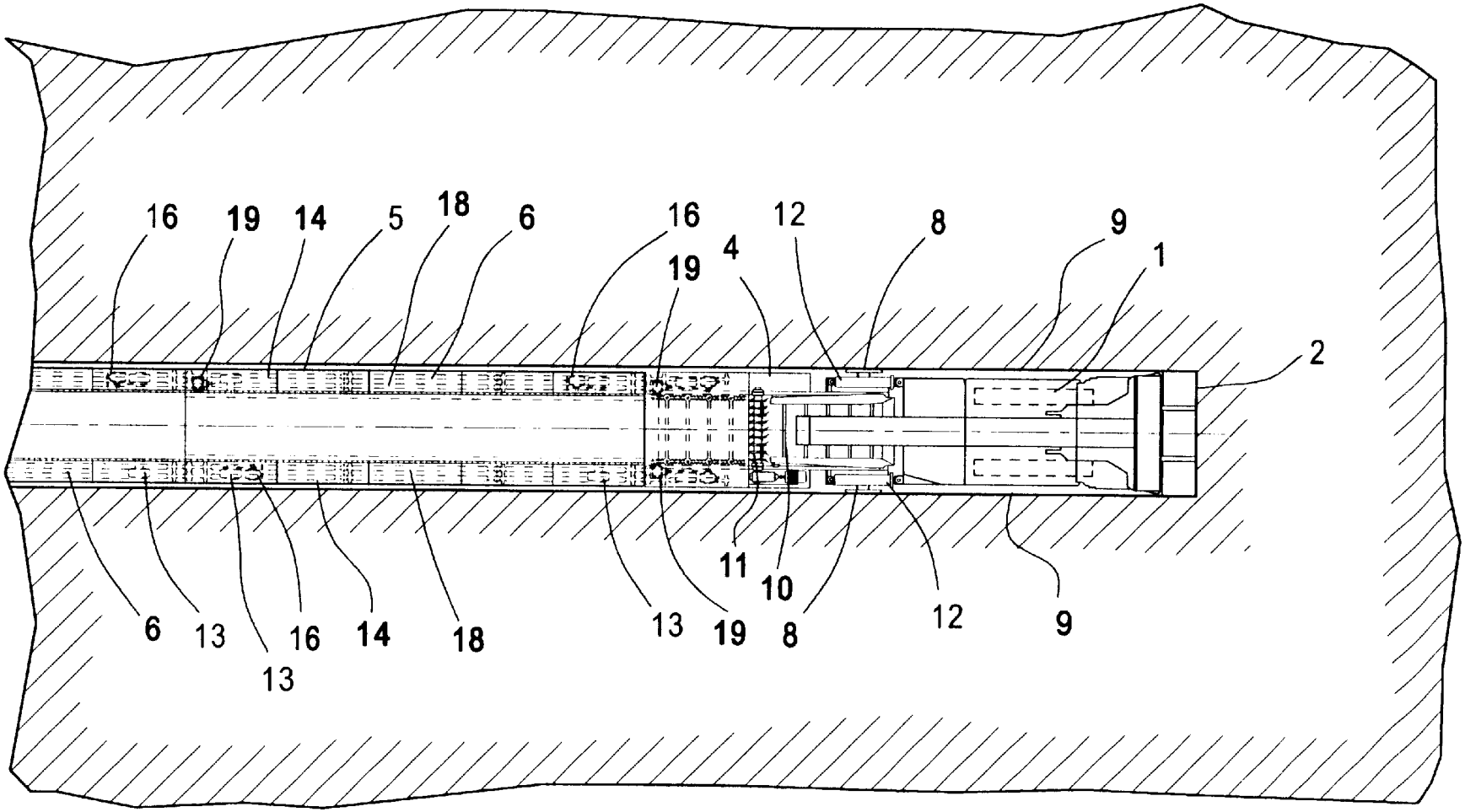
FIG. 4 is a schematic plan view taken along line II—II of FIG. 3.
Figure 4A:
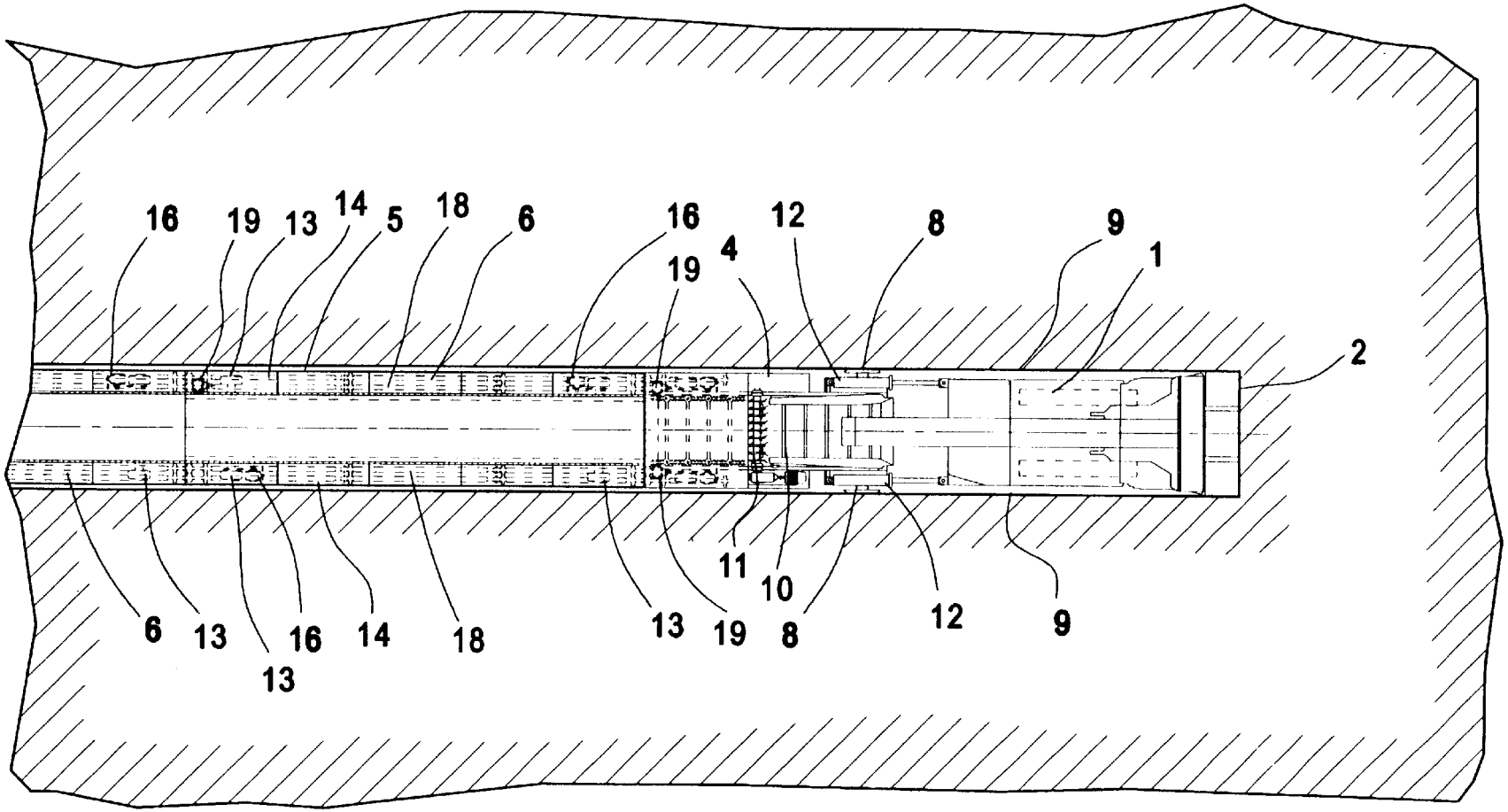
FIG. 4A is a schematic plan view taken along line II—II of FIG. 3, showing the extender extended and the mining machine advanced ahead of the conveying assembly.
Figure 4B:
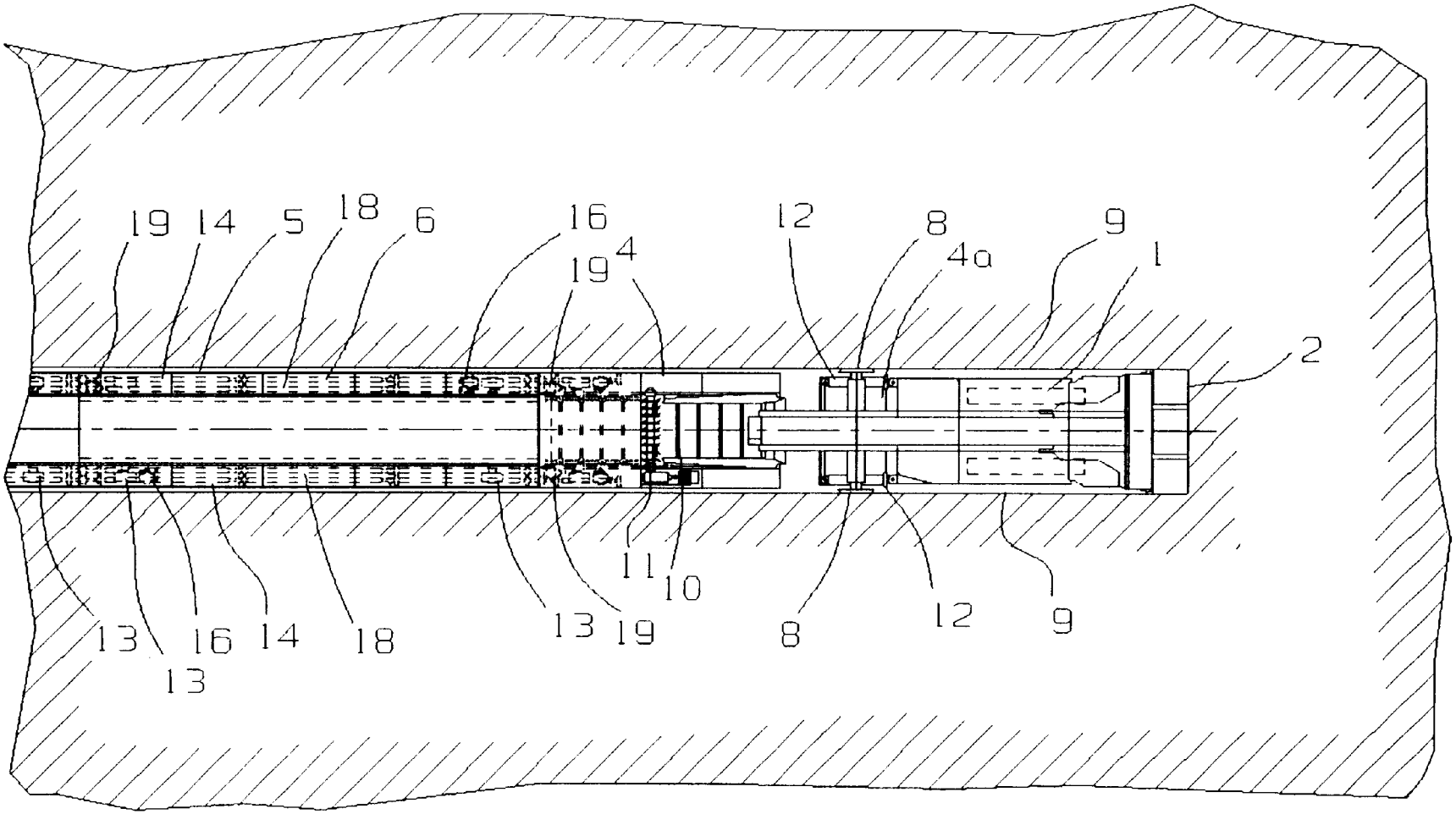
FIG. 4B is a schematic plan view taken along line X—X of FIG. 3A.
Figure 5:
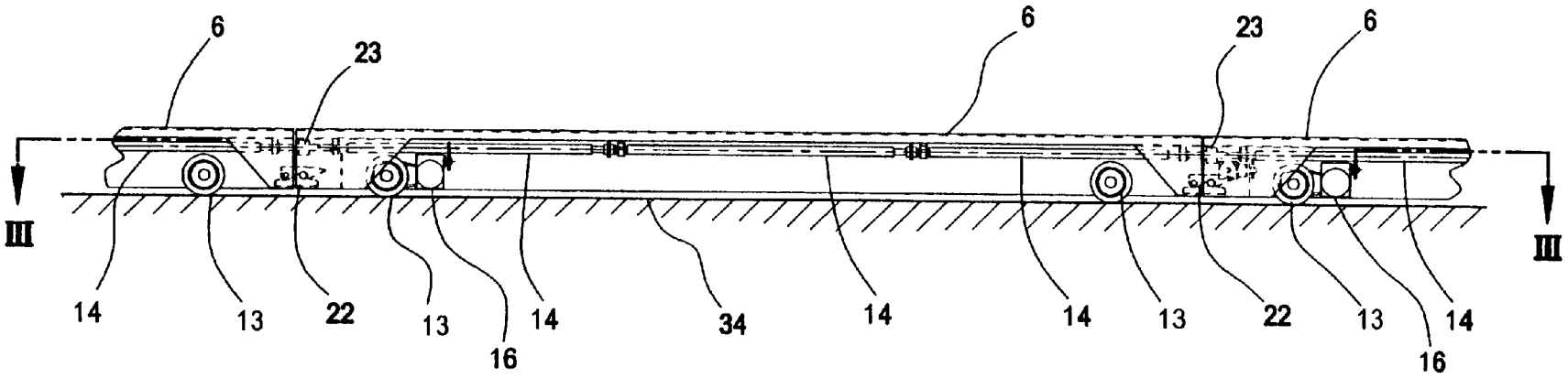
FIG. 5 is a schematic side view of a component of the conveying assembly utilizing belt conveyors.
Figure 6:
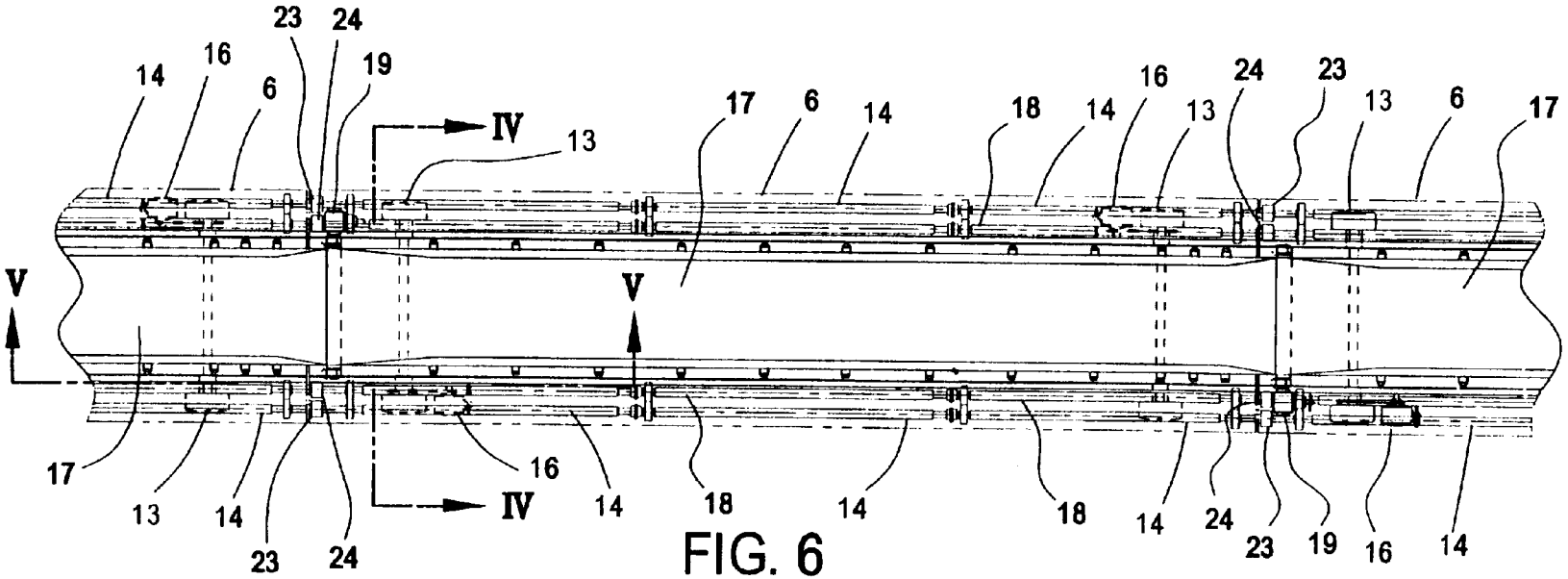
FIG. 6 is a schematic plan view taken along line III—III of FIG. 5.
Figure 7:
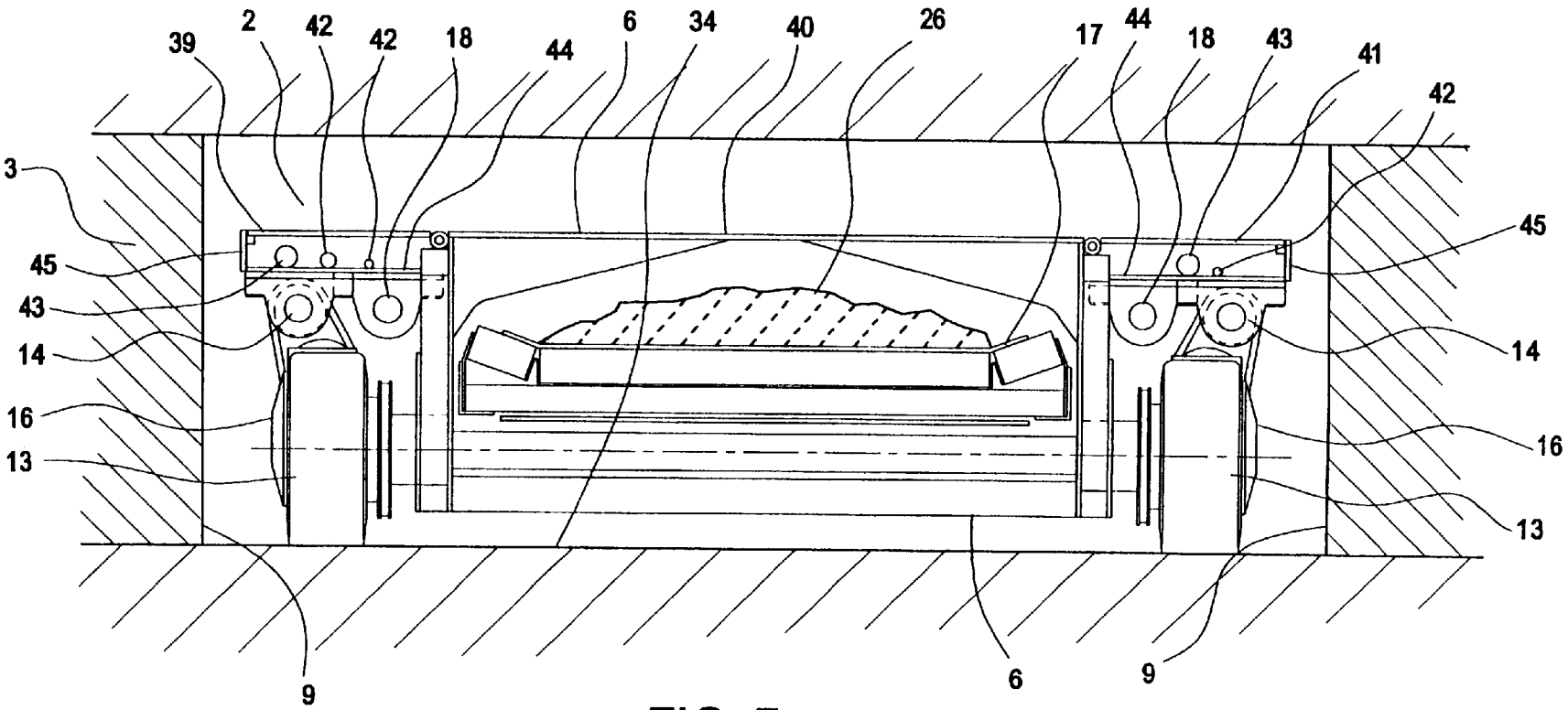
FIG. 7 is a schematic sectional view taken along line IV—IV of FIG. 6.
Figure 8:
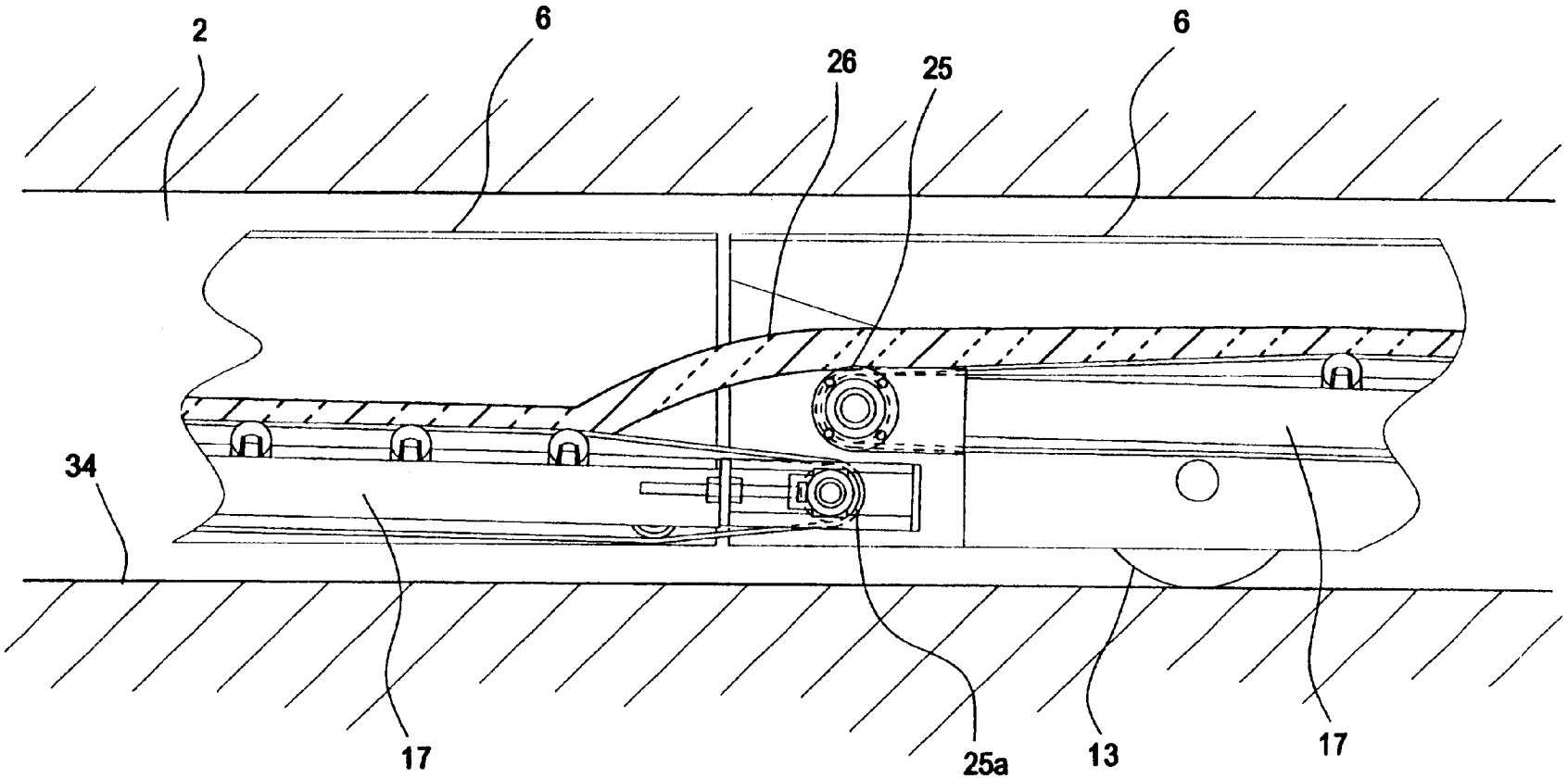
FIG. 8 is a schematic sectional view taken along line V—V of FIG. 6.

Referring to FIGS. 3A and 4B, in an alternate embodiment, advancing cylinders 12 and side jacks 8 are mounted on an advancing machine 4*a* separate from the receiving module 4. The advancing cylinders 12 of the machine 4*a* are connected to the mining machine 1. The receiving module 4 is not fixedly connected to the advancing machine 4*a* and the receiving module 4 with the self-propelled conveying assembly 5 can advance into the mine opening 2 independently of the mining machine 1 and the advancing machine 4*a*.

A very important aspect of this invention is the manner in which the self-propelled conveying assembly 5 advances into the mine opening 2 excavated by the mining machine 1. Unlike other systems currently in use, all modules of the conveying assembly 5, including all the intermediate modules 6 and the receiving module 4, have one or more propelling devices 13—driven axles with wheels are shown in the figures. The driven axles 13 are capable of generating a traction force to propel the conveying assembly either forward or backward. Driven axles 13 receive power from one or more drive shafts 14 driven from the drive module 7 located on the mining platform 15, through drives 16. As all the driven axles 13 are interconnected through the drive shafts 14, they are forced to advance or retreat at the same speed, regardless of the torque they may require. The whole conveying assembly 5 advances or retreats at the same speed without any appreciable push or pull within the conveying assembly 5, thus assuring a uniform and problem-free advance or retreat.

In a preferred embodiment of the present invention, individual conveyors 17 mounted within the intermediate modules 6 and the feeder 10 of the receiving module 4 also receive power from at least one drive shaft 18, which is driven from the drive module 7 located on the mining platform 15, through drives 19. Alternatively, individual drives, such as electric motors, located on modules 6 can be used to power modules 4, 6 and/or conveyors 17 and/or feeder 10.

Figure 1A:
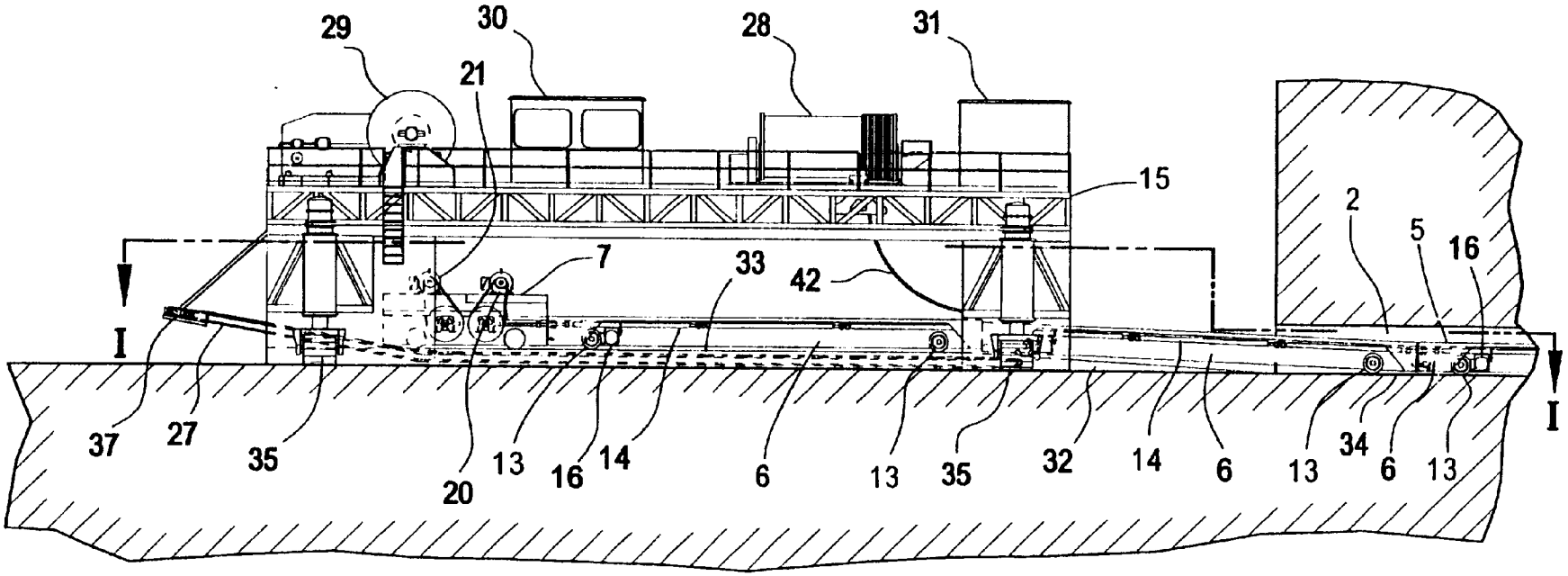
FIG. 1A is a schematic side view of the assembly in FIG. 1, showing the conveying assembly advancing into the seam.
Figure 2:
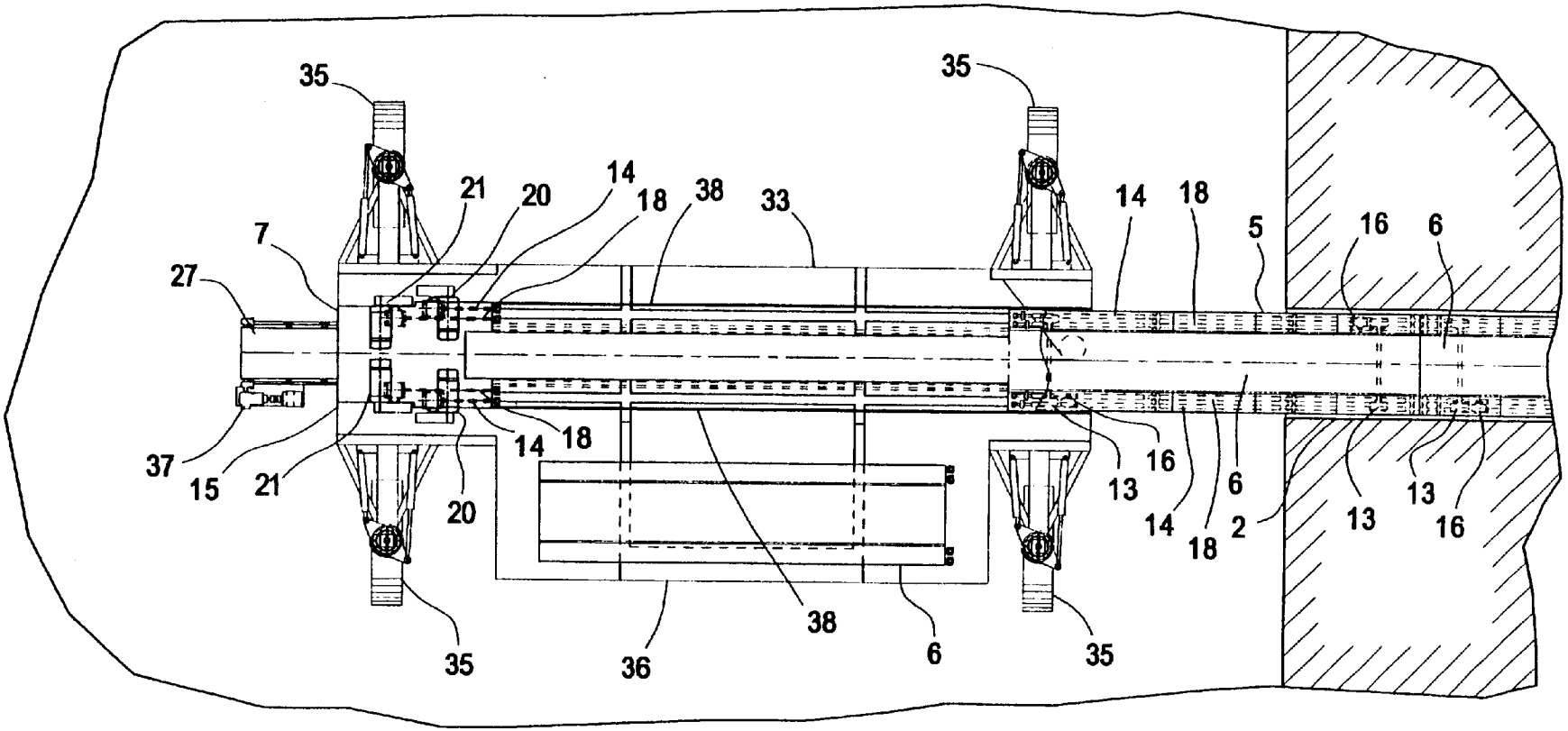
FIG. 2 is a schematic plan view taken along line I—I of FIG. 1.
Figure 2A:
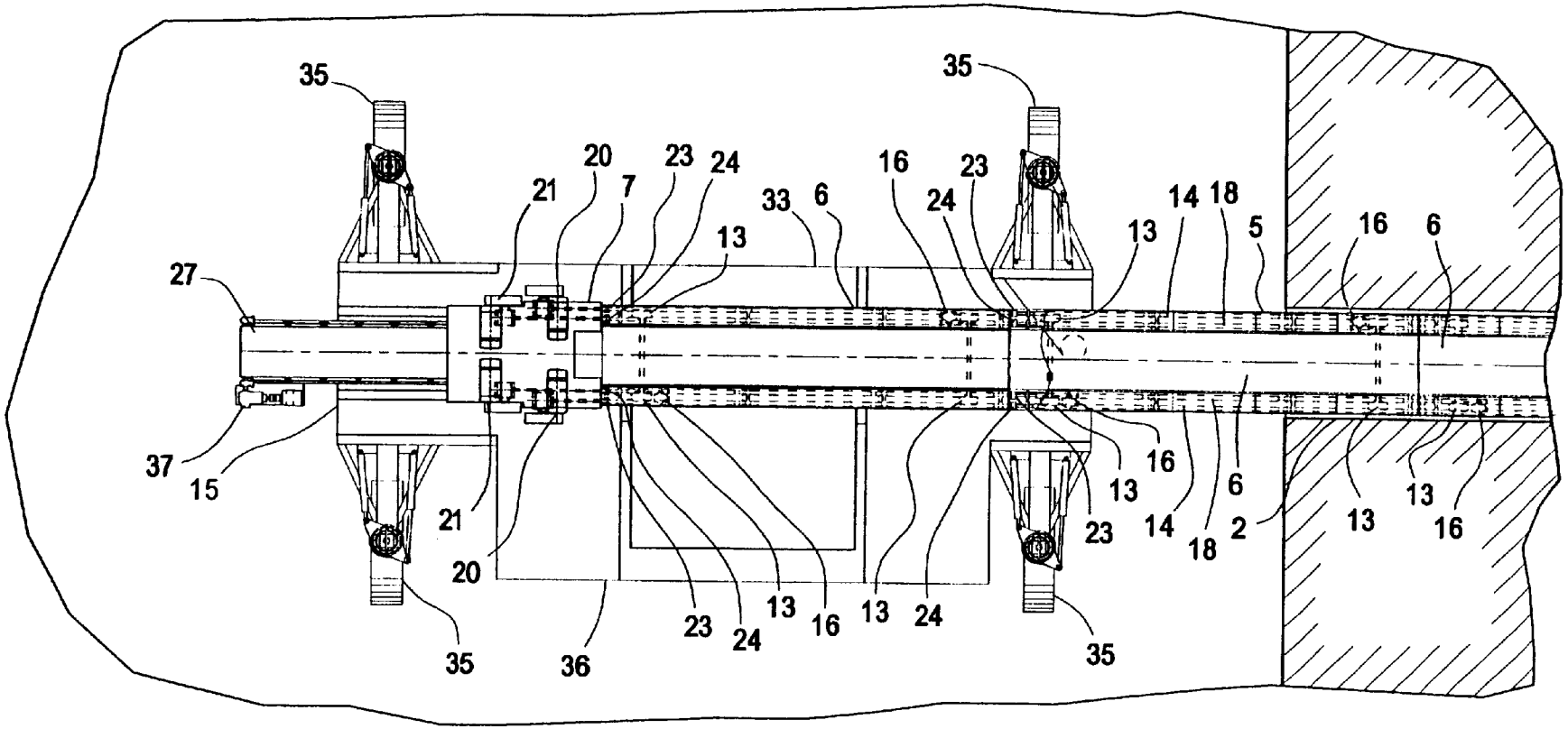
FIG. 2A is a schematic plan view taken along line I—I of FIG. 1A.
Figure 26:
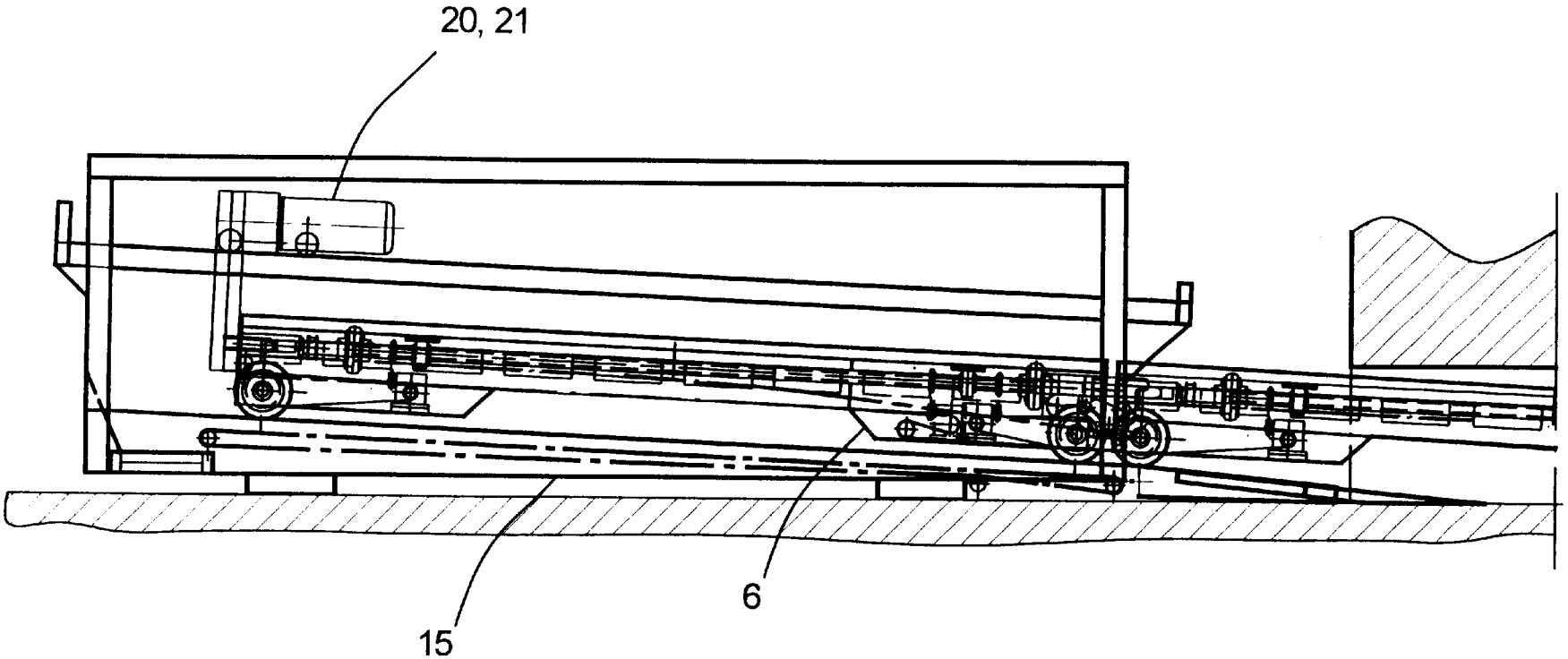
FIG. 26 shows an alternate embodiment of the platform of the present invention.

The drive module 7 includes tram power drives 20 that power the drive shafts 14 and conveyor power drives 21 that power the drive shafts 18. FIG. 1*a* shows drives 20,21 located on the same level as the intermediate module 6. Alternatively, drives 20,21 can be positioned above module 6, as seen in FIG. 26. In this latter embodiment, drives 20,21 are movably positioned on rails above module 6. This embodiment provides additional working space on platform 15.

During the advancing or retrieval operation, all components of the conveying assembly 5, including the drive module 7, the intermediate modules 6 and the receiving module 4, are coupled together by couplings 22 while the drive shafts 14 are coupled together by drive couplings 23 and drive shafts 18 are coupled by drive couplings 24. When the intermediate modules 6 are coupled, the head ends 25 and the tail ends 25A of the conveyors 17 overlap in order to facilitate transfer of the material 26.

The mining platform 15 includes a discharge conveyor 27, the drive module 7, cable and hose winders 28, winches 29, a control room 30, an electrical room 31, a retractable ramp 32, and other required equipment and facilities. The retractable ramp 32 accommodates the elevation difference between the bottom deck 33 of the platform 15 and the bottom 34 of the seam 3. Tracks 35 or other modes of transportation are provided to facilitate positioning of the mining platform 15 with respect to the mine opening 2.

An important aspect of this invention is the method and apparatus of adding intermediate modules 6 to the conveying assembly 5. The extended bottom deck 33 includes a sliding table 36. Cargo handling equipment such as a commonly available forklift or a front-end loader is used to deposit an intermediate module 6 onto the sliding table 36. When the conveying assembly 5 advances into the mine opening 2 a full length of one intermediate module 6, the drive module 7 is disconnected from the last rearward intermediate module 6 and moved toward the discharge end 37 of the discharge conveyor 27, by a moving mechanism 38 attached to the drive module 7, thus generating a gap in the conveying assembly 5 that is greater than the length of an intermediate module 6. The sliding table 36 with an intermediate module 6 is moved sideways until the intermediate module 6 is lined up with the conveying assembly 5 at which point the drive module 7 is moved toward the new intermediate module 6 and all the components of the conveying assembly 5 are reconnected. As the drive shafts 14 and 19 are also reconnected through couplings 23 and 24, all axles 13 and conveyors 17 are powered and begin operating.

The intermediate modules 6 contain protective plates 39, 40 and 41 in order to protect mechanical and electrical components of the conveying assembly 5, including conveyor 17, electrical cables 42 and hoses 43. For this purpose, the electrical cables 42 and the hoses 43 are laid into structural trays 44. The sides 45 of the structural trays 44 also perform a function of guiding the conveying assembly 5 within the walls 9 of the mine opening 2.

Figure 9:
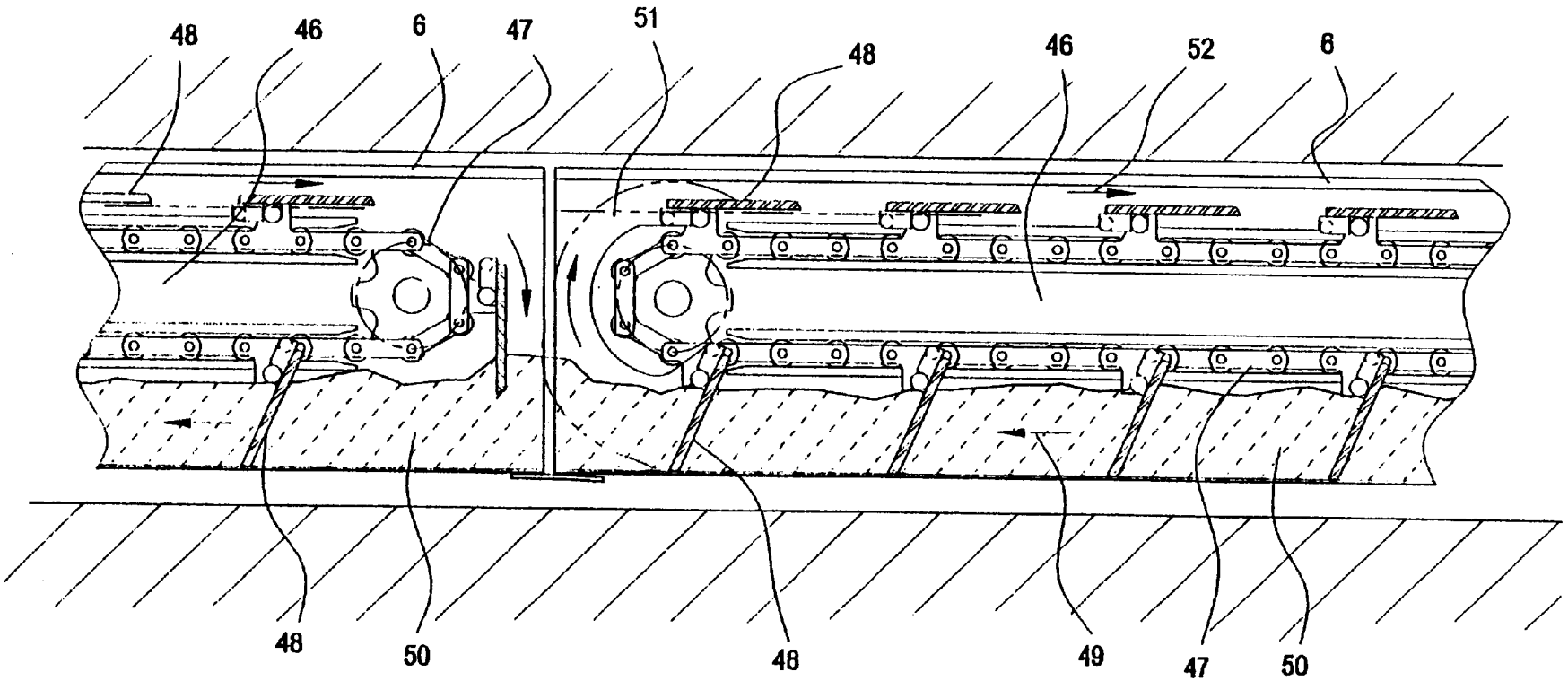
FIG. 9 is a schematic sectional view similar to FIG. 8, utilizing chain conveyors.
Figure 10:
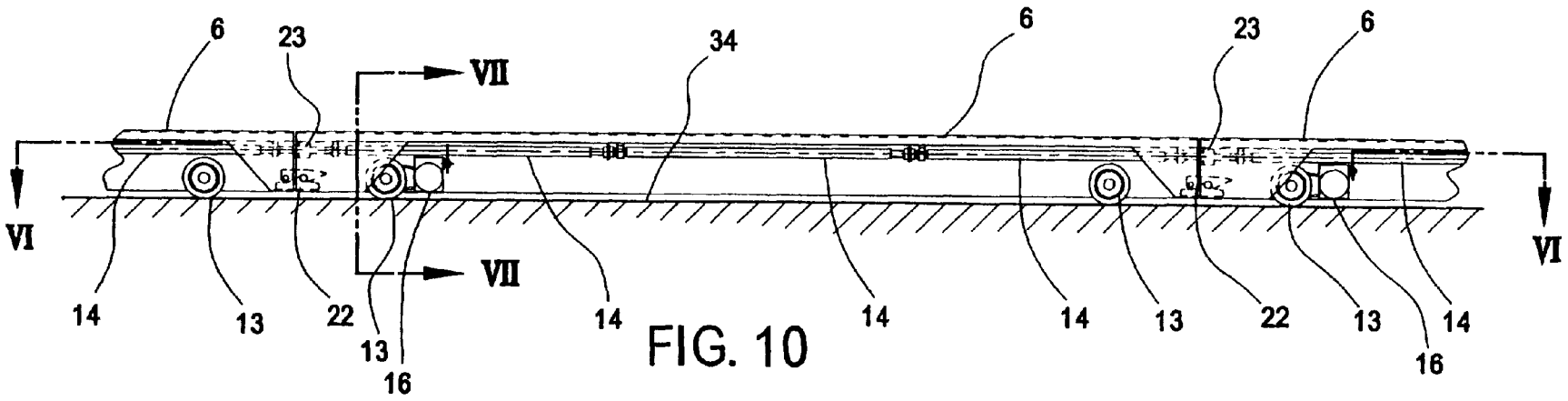
FIG. 10 is a schematic side view of a component of the conveying assembly utilizing a reciprocating conveyor.
Figure 11:
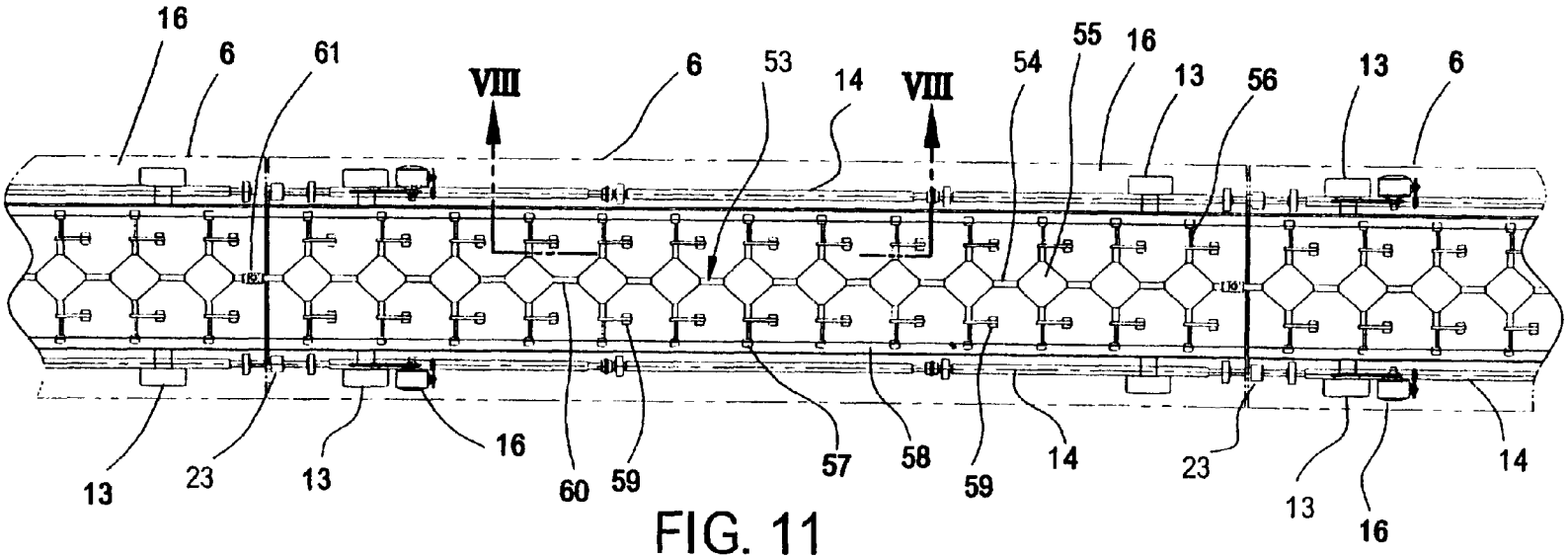
FIG. 11 is a schematic plan view taken along line VI—VI of FIG. 10.
Figure 12:
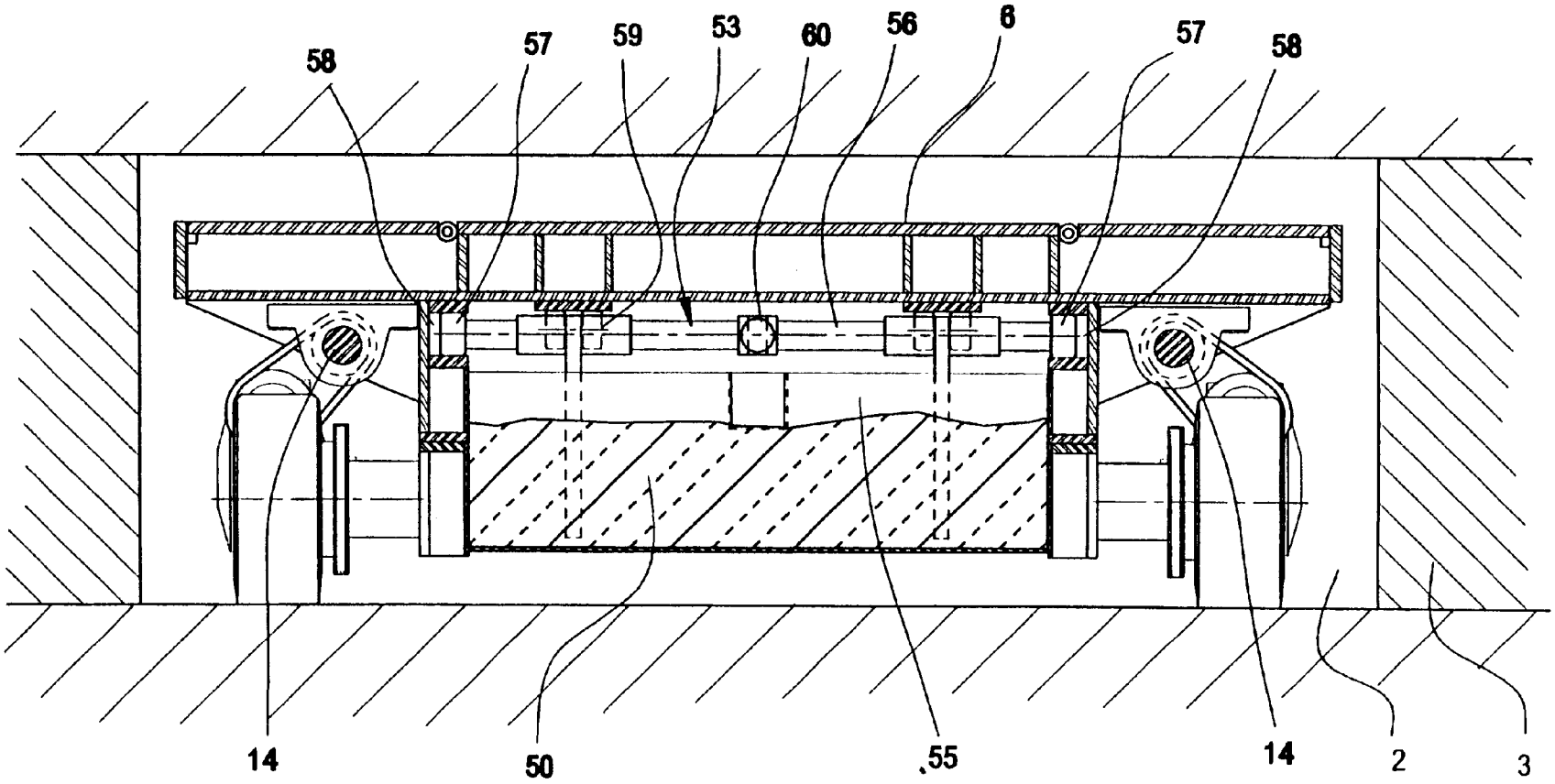
FIG. 12 is a schematic sectional view taken along line VII—VII of FIG. 10, of a preferred embodiment of reciprocating conveyor utilizing push plates.
Figure 13:
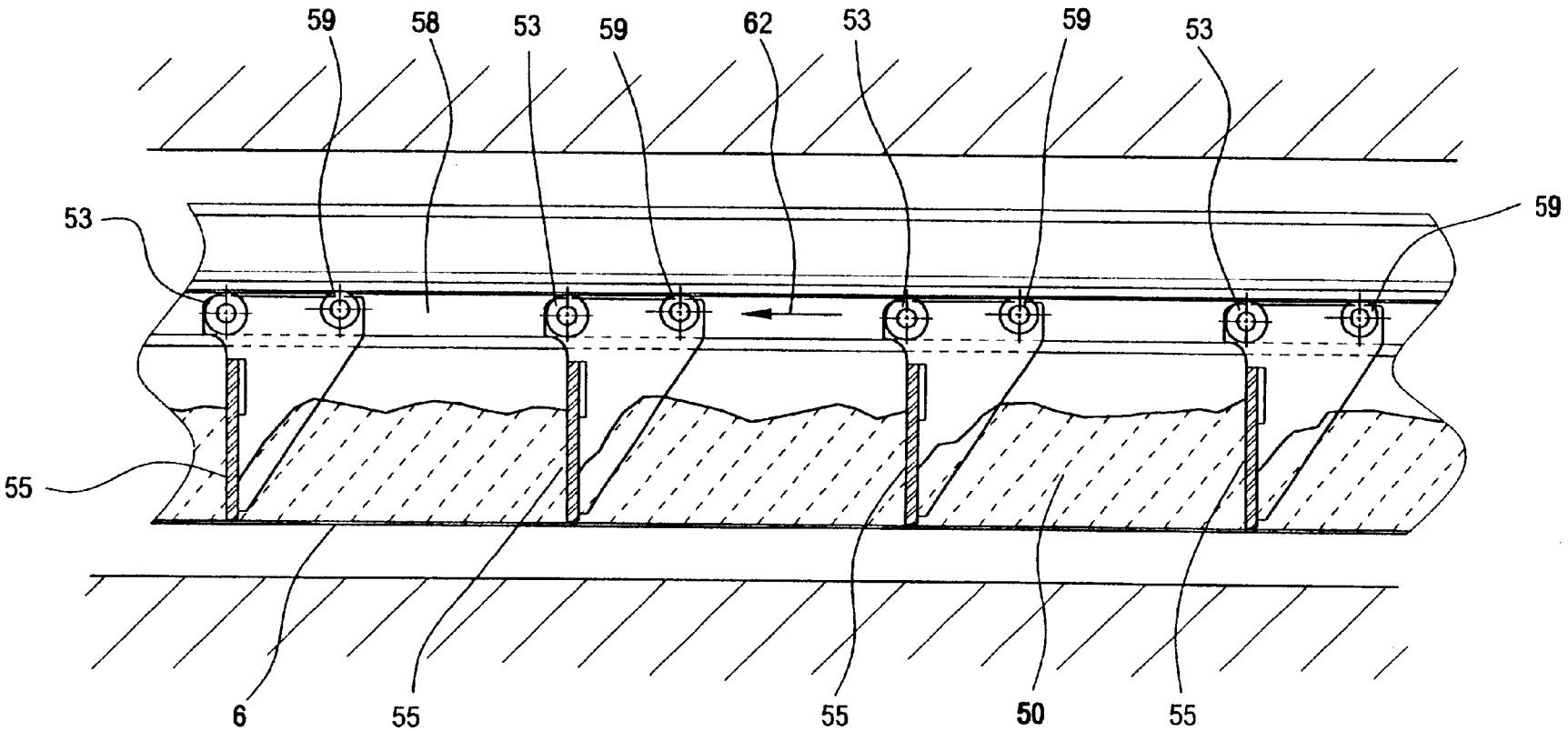
FIG. 13 is a schematic sectional view taken along line VIII—VIII of FIG. 11, of a preferred embodiment of reciprocating conveyor utilizing push plates, with push plates in a rearward motion.
Figure 14:
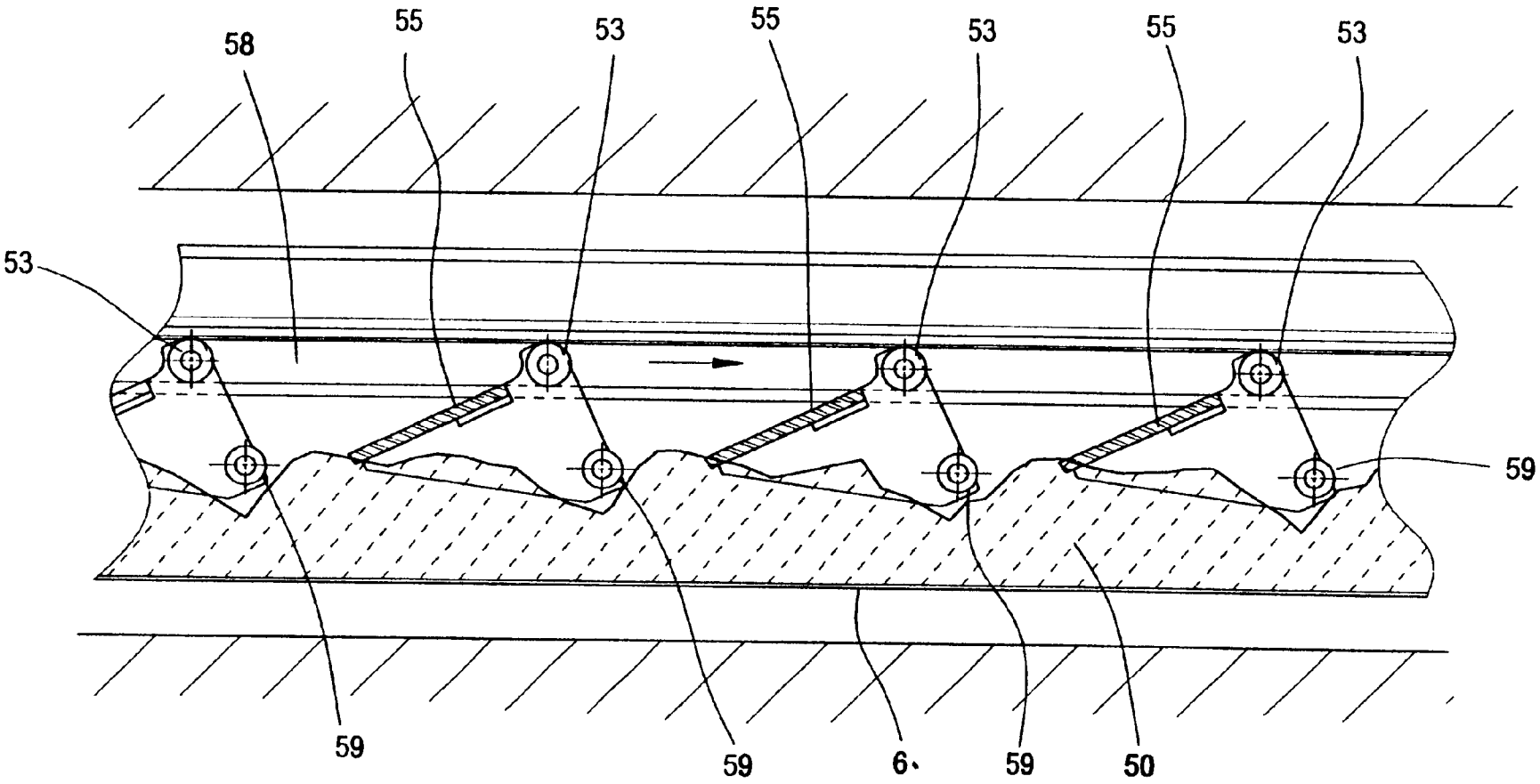
FIG. 14 is a schematic sectional view taken along line VIII—VIII of FIG. 11, of a preferred embodiment of reciprocating conveyor utilizing push plates, with push plates in a forward motion.

Referring to FIG. 9, chain conveyors 46 are mounted within the intermediate modules 6. The chain 47 includes flights 48 that swing downwards by gravity when they travel in the direction of transport shown by an arrow 49 and push the aggregate or other material 50 within the intermediate module 6. In order to make the conveyors 46 more space efficient, a cam 51 swings the flights 48 to a horizontal position during their return path shown by an arrow 52.

FIGS. 10 through 14 show a schematic of the intermediate modules 6 with a reciprocating conveyor 53. Each module 6 contains a section 54 of a reciprocating conveyor 53. Each section 54 contains flights 55 with transverse shafts 56, rollers 57 that run in guides 58, supporting rollers 59 and a longitudinal shaft 60. The shafts 60 of sections 54 are connected by couplings 61 and form a single shaft connected to a reciprocating mechanism mounted on the drive module 7 located on the mining platform 15. When the flights 55 are moved in the direction of transport designated by an arrow 62, they swing into a substantially vertical position and push the material 50 within the intermediate module 6 in the direction of transport. When the flights 55 are moved in the opposite direction, they swing into a substantially horizontal position by the resistance of the material 26 and return without pushing the material 50.

Figure 15:
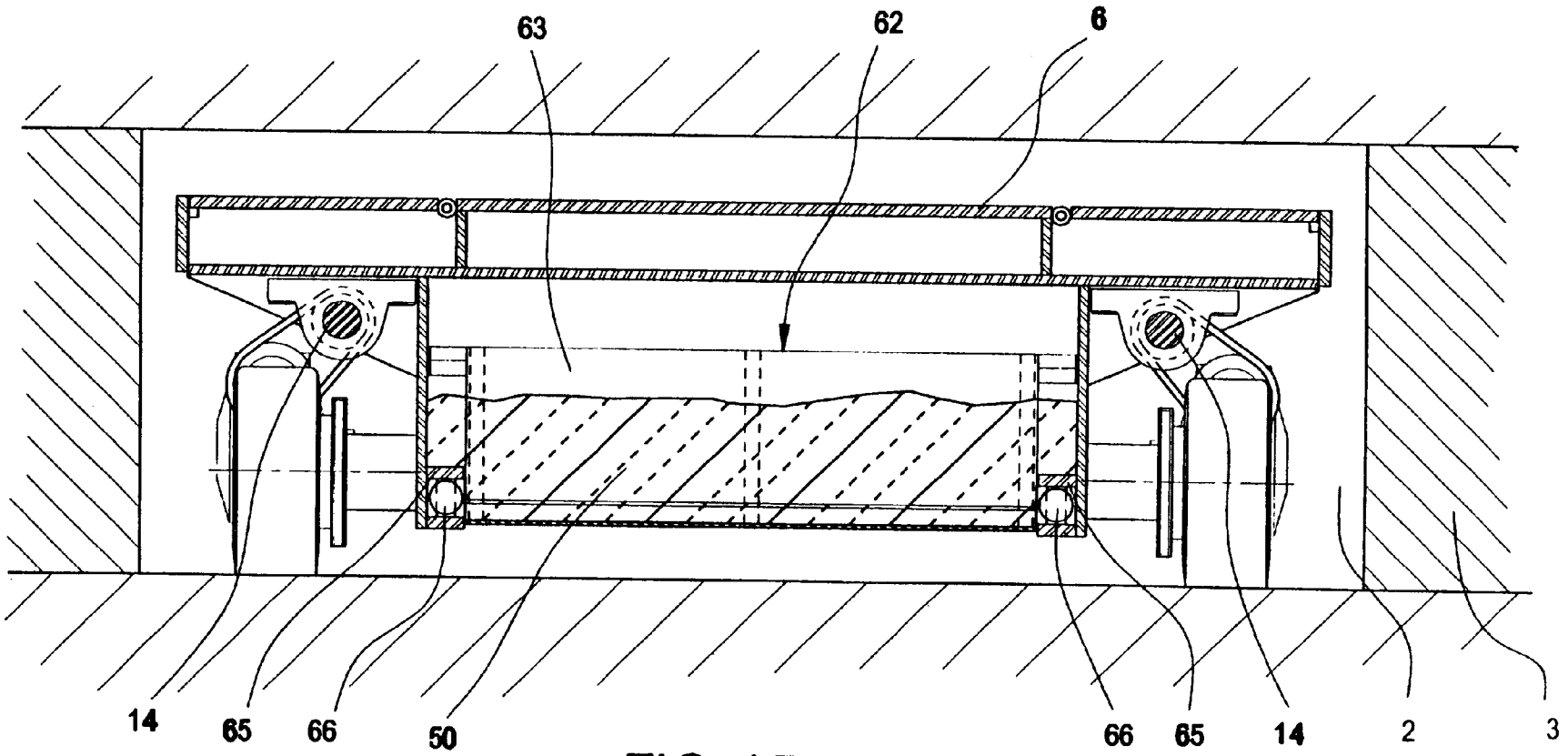
FIG. 15 is a schematic cross sectional view of another embodiment of reciprocating conveyor utilizing push plates, with push plates in a rearward motion.
Figure 16:
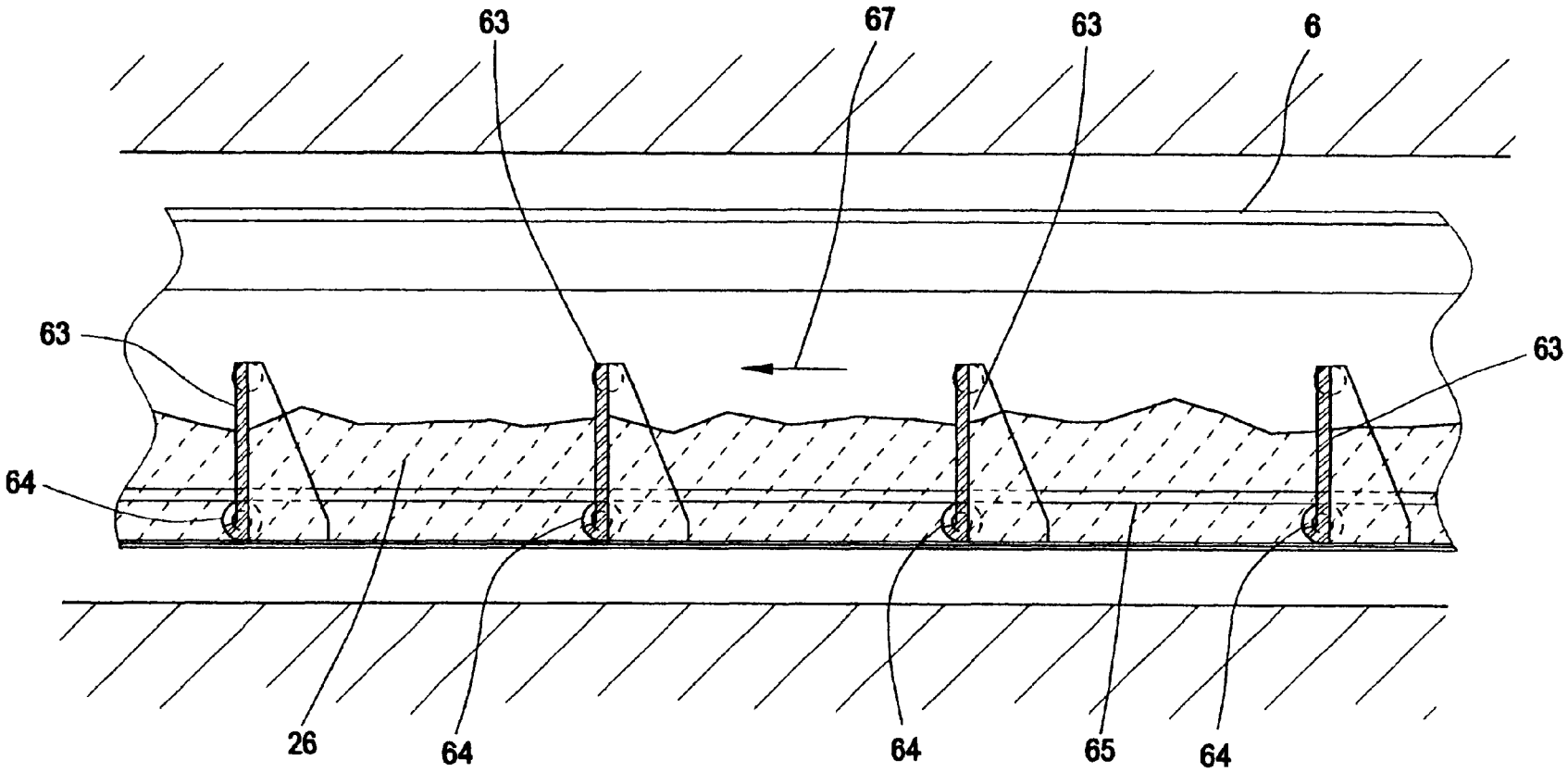
FIG. 16 is a schematic sectional view of another embodiment of reciprocating conveyor utilizing push plates, with push plates in a rearward motion.
Figure 17:
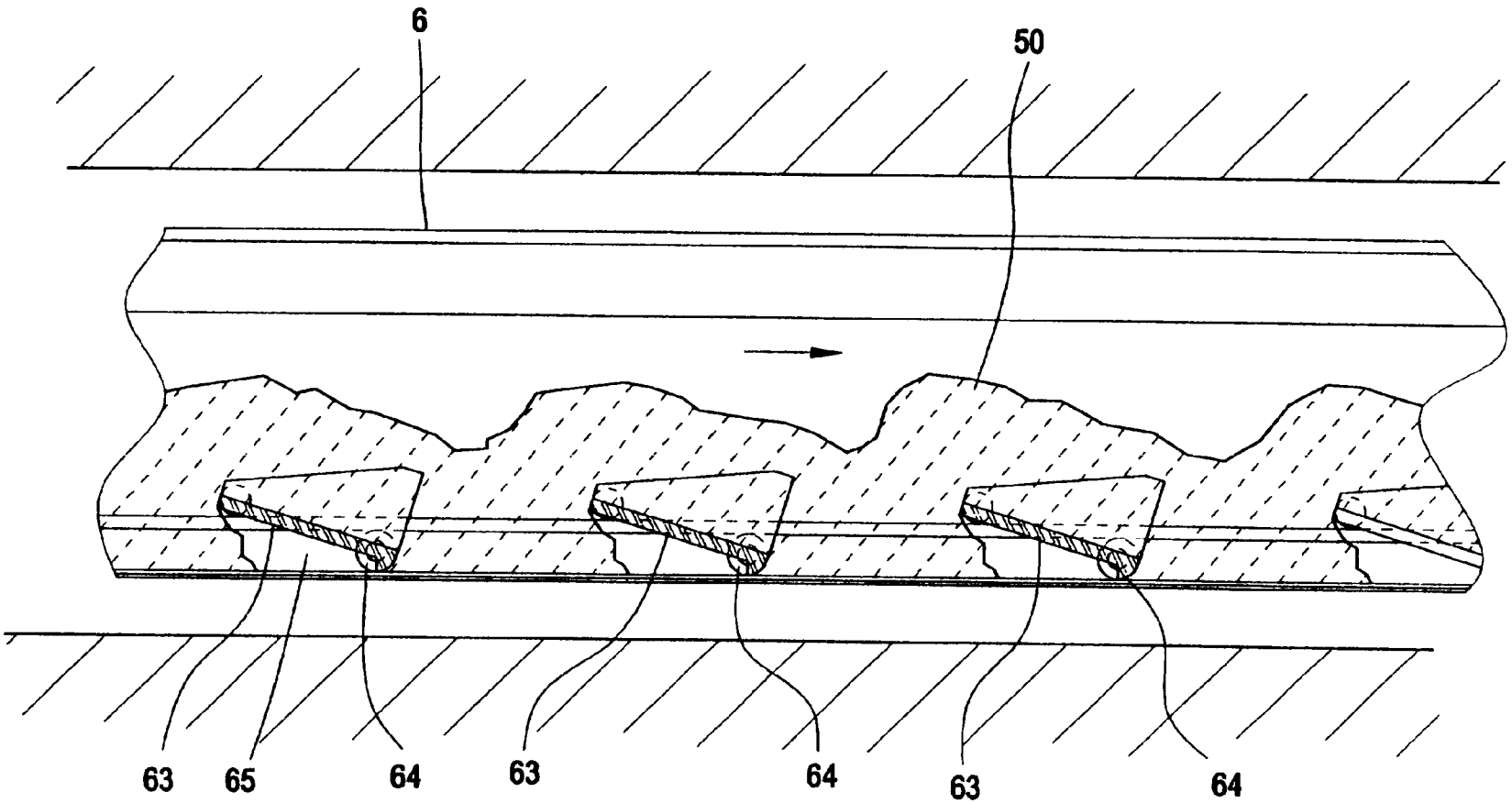
FIG. 17 is a schematic sectional view of another embodiment of reciprocating conveyor utilizing push plates, with push plates in a forward motion.

FIGS. 15 through 17 show a schematic of the intermediate modules 6 with another embodiment of a reciprocating conveyor 62 containing flights 63 with rollers 64 that run in guides 65 within longitudinal linkages 66. When the flights 63 are moved in the direction of transport designated by an arrow 67, they swing into a substantially vertical position and push the material 50 within the intermediate module 6 in the direction of transport. When the flights 63 are moved in the opposite direction, they swing into a substantially horizontal position by the resistance of the material 50 and return without pushing the material 50.

Figure 18:
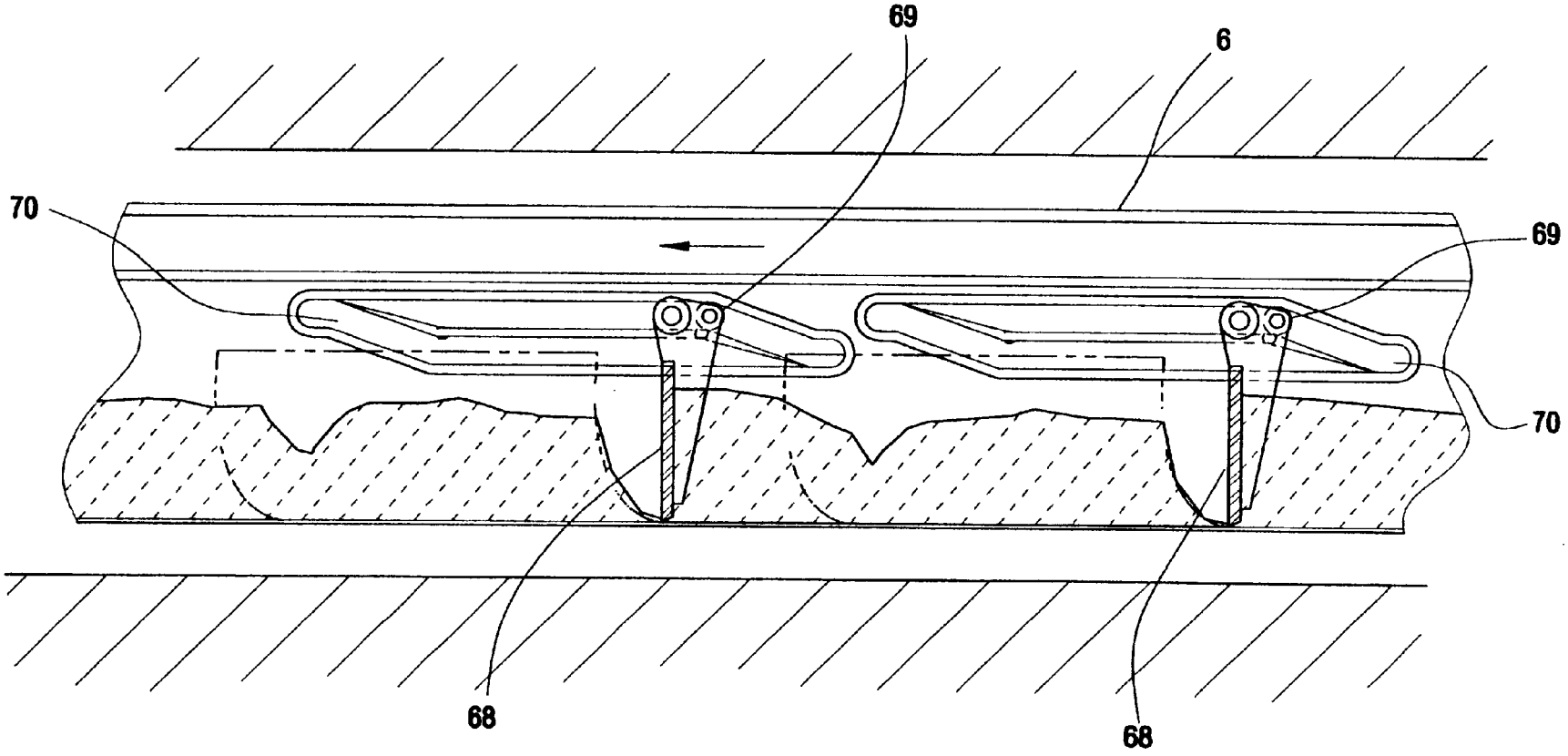
FIG. 18 is a schematic sectional view of yet another embodiment of reciprocating conveyor utilizing push plates, with push plates in a rearward motion.
Figure 19:
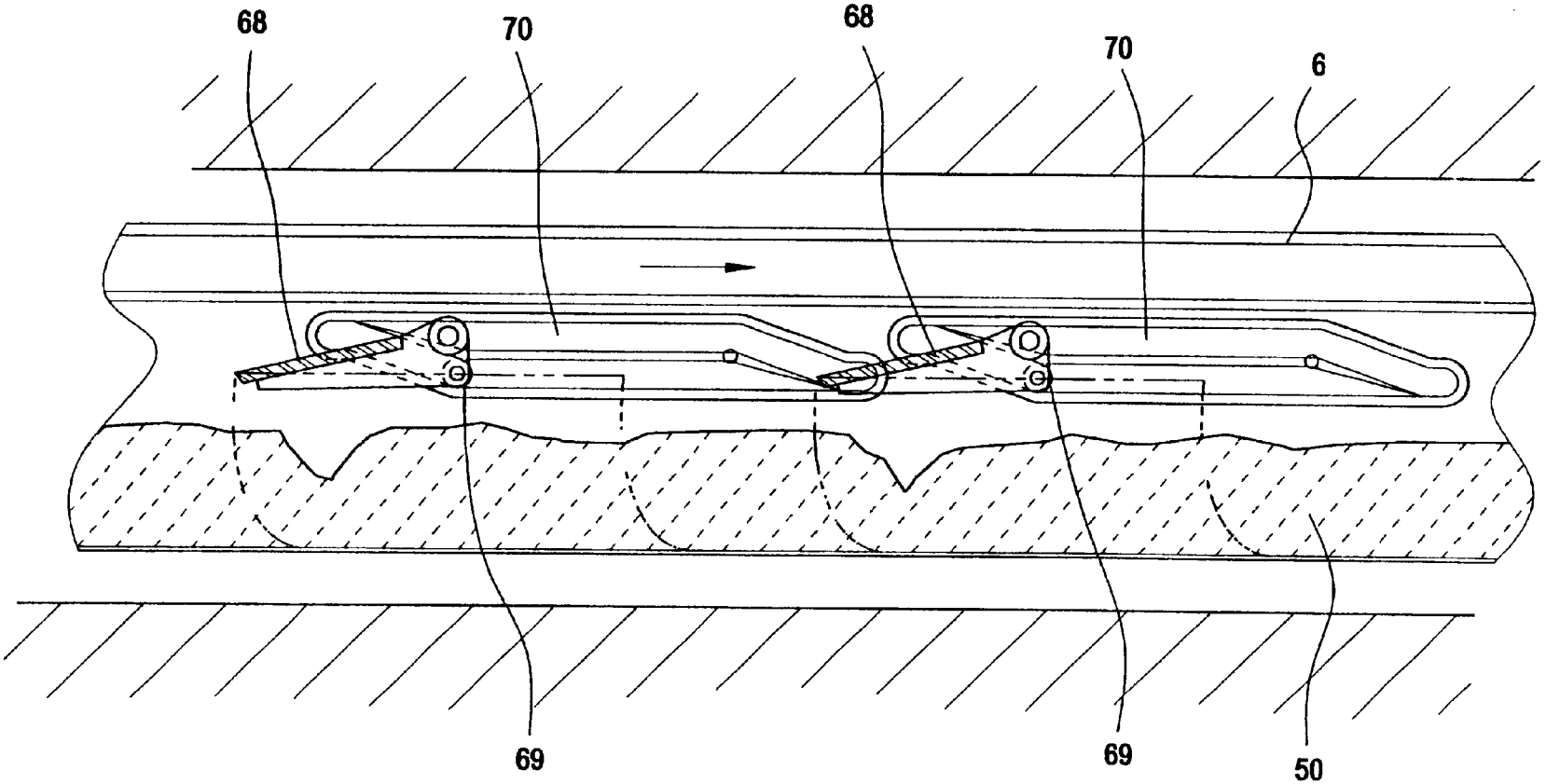
FIG. 19 is a schematic sectional view of yet another embodiment of reciprocating conveyor utilizing push plates, with push plates in a forward motion.

FIGS. 18 and 19 show a schematic of the intermediate modules 6 with yet another embodiment of a reciprocating conveyor. In this embodiment, flights 68 are moved into a substantially vertical position when moving in the direction of transport and into a substantially horizontal position when moving in an opposite direction by cams 69 moving within guides 70.

Figure 20:
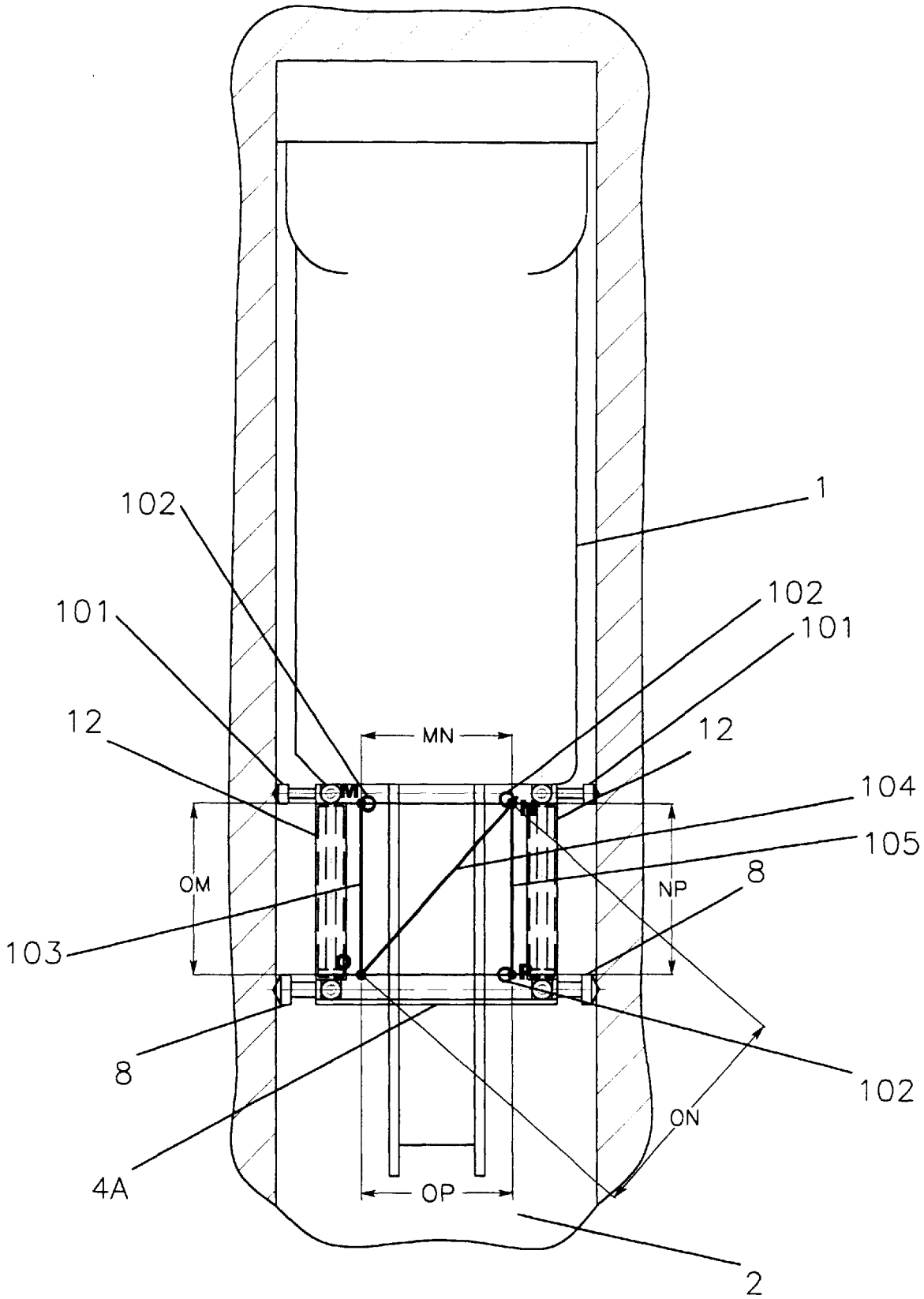
FIG. 20 is a plan view of another embodiment of the advancing machine including a navigation system for a remote operation, with the extender retracted.
Figure 21:
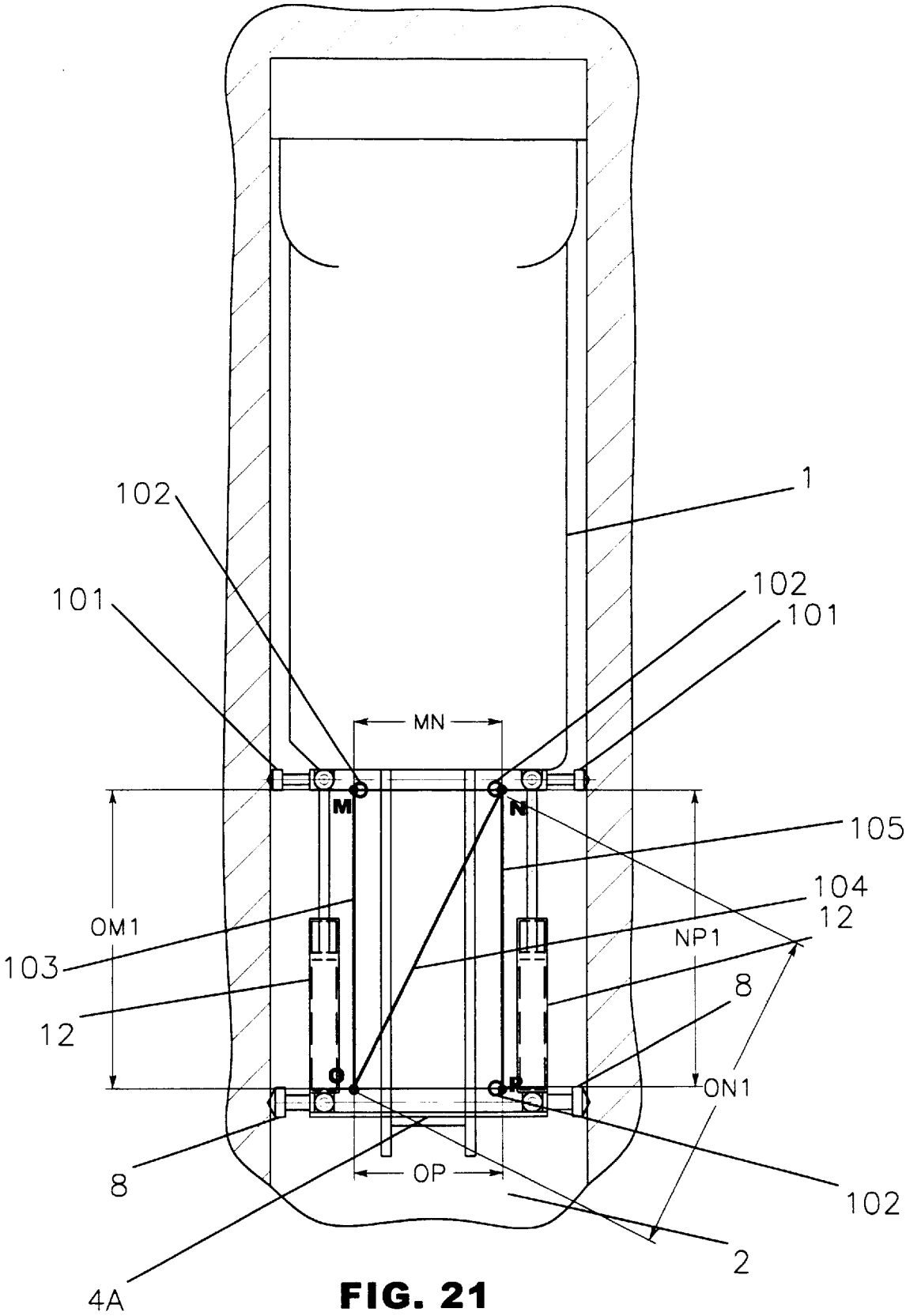
FIG. 21 is a plan view of the advancing machine with a navigation system, with the extender extended.
Figure 22:
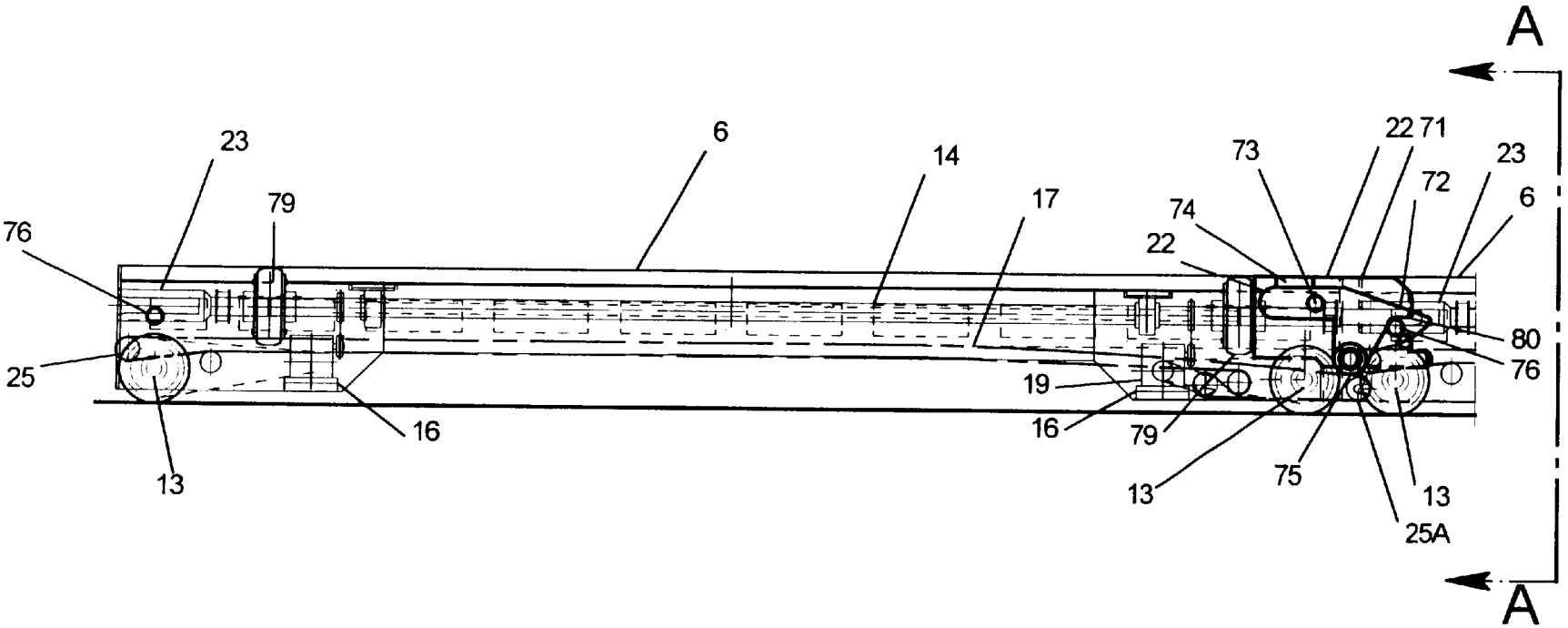
FIG. 22 is a side view of a preferred embodiment of the intermediate module with couplings engaged to connect the intermediate modules.
Figure 23:
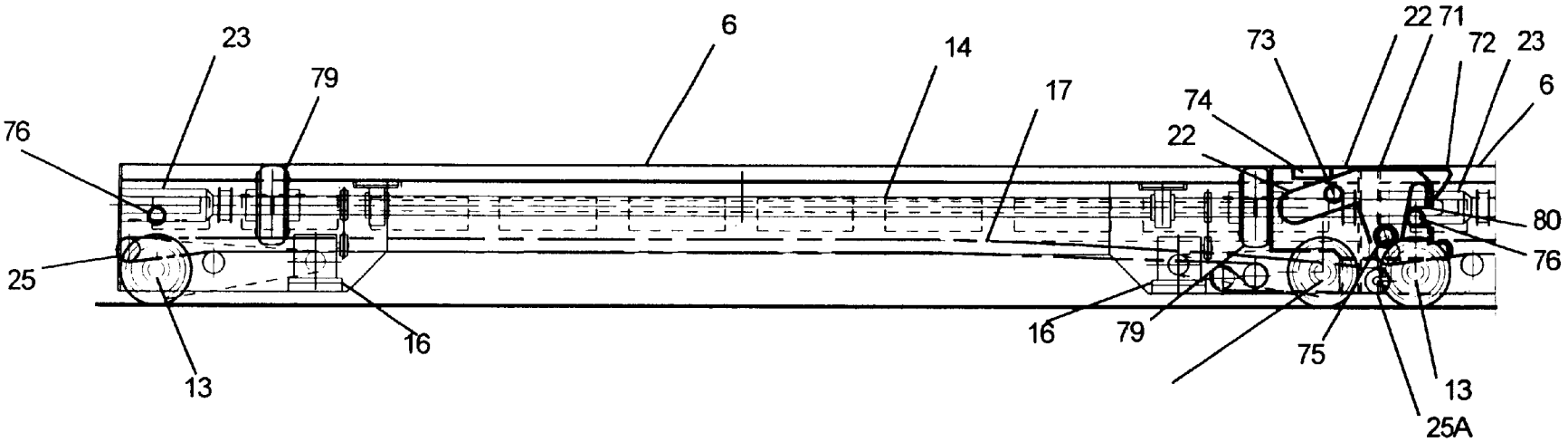
FIG. 23 is a side view of a preferred embodiment of the intermediate module with couplings disengaged to disconnect the intermediate modules.
Figure 24:
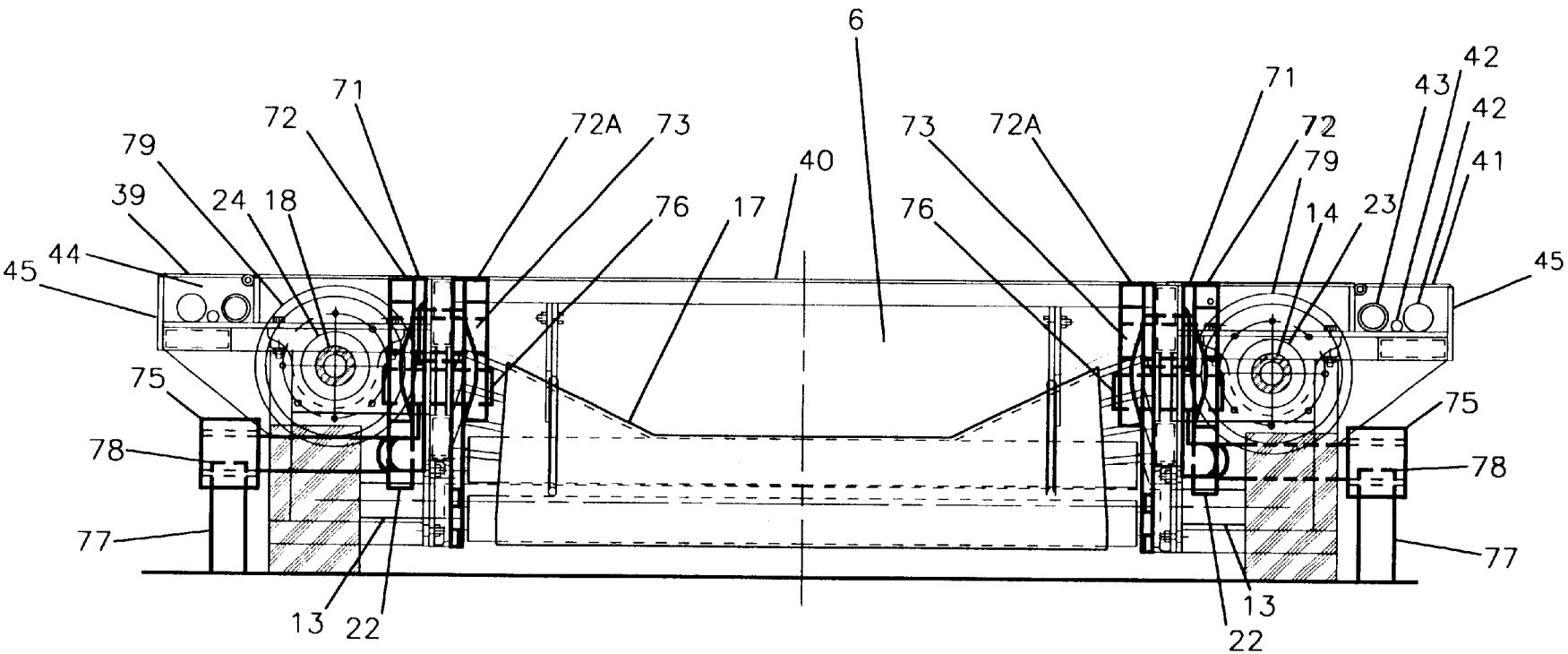
FIG. 24 is a schematic sectional view taken along line A—A of FIG. 22.
Figure 25:
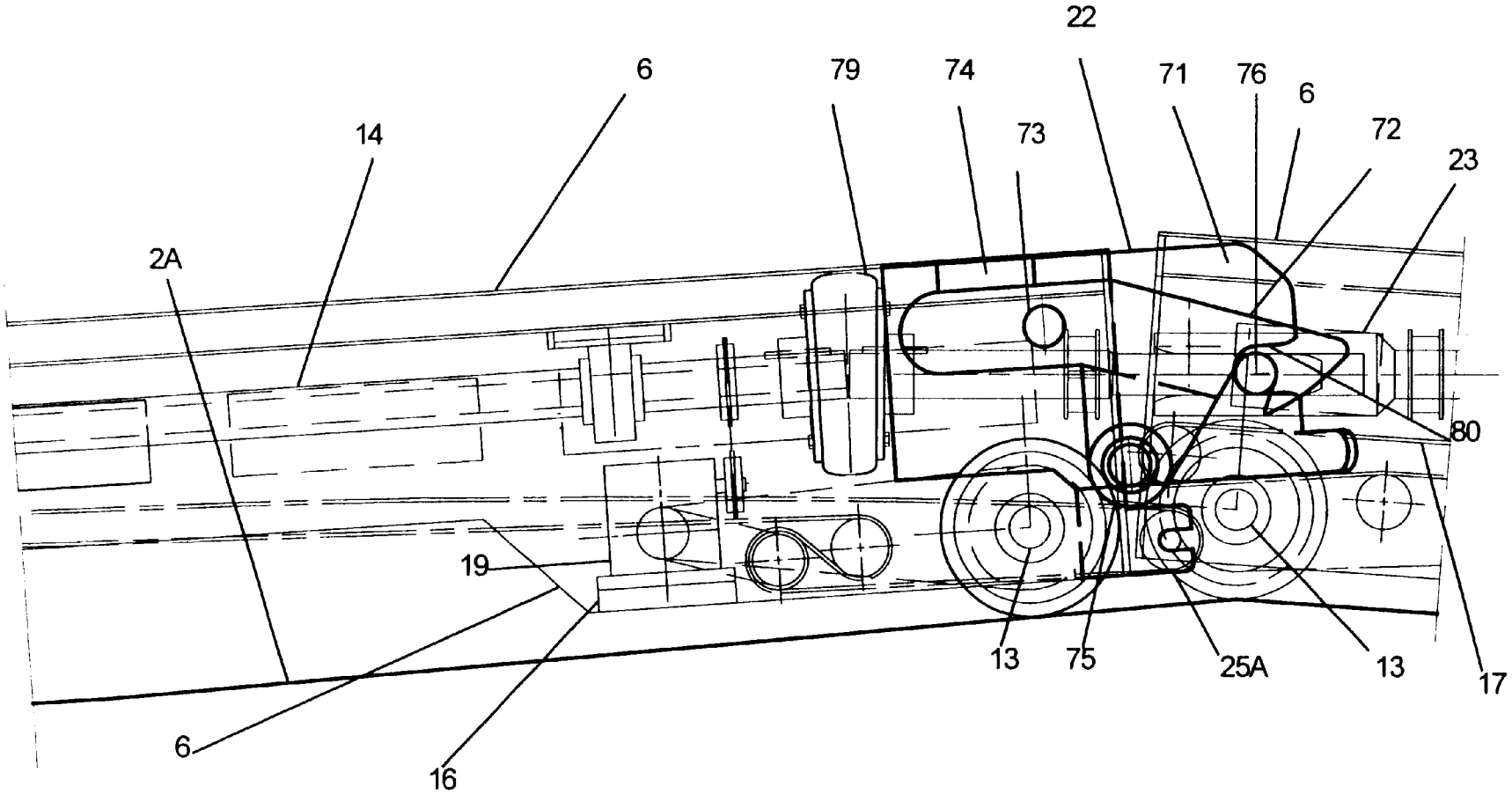
FIG. 25 is a side view of a coupling assembly of the embodiment of FIG. 22.

Referring to FIGS. 20 and 21, in an alternate embodiment, the advancing module 4*a* with advancing cylinders 12 and side jacks 8 also contains secondary braces, in the form of side jacks, 101 and distance measuring means 103, 104 and 105 with readout instruments 102. Before the mining machine 1 is advanced and steered within the mine opening 2 via advancing cylinders 12, the distance measuring means 103, 104 and 105 are used to record distances OM, ON, and NP. Since the distances MN and OP are fixed, the relative positions of points M, N, O and P can be determined by triangulation (using the cosine and sine theorems provided below). This also determines the relative position of the advancing machine 4*a* and the mining machine 1. When the mining machine 1 is advanced to a new position within the mine opening 2, the secondary side jacks 101 are extended, the mining machine 1 is fixed within mine opening 2, the new distances OM1, ON1 and NP1 are measured and the new positions of points M and N are determined relative to points O and P. Next, the side jacks 8 are released and cylinders 12 are retracted. When the cylinders 12 are fully retracted, the side jacks 8 are extended, again fixing the advancing module 4*a* within the opening 2, and the distances OM, ON, and NP are measured. The new position of points O and P relative to points M and N are determined as before. By repeating this cycle, the position of mining machine 1 as it is advanced within the mine opening 2 is determined at regular intervals and, accordingly, the mining machine 1 is steered by advancing cylinders 12 to maintain the desired direction of mining. Advancing machine 4*a* may also contain one or more inclinometers to measure vertical displacement (if any) of mining machine 1. The inclinometers are contained within advancing machine 4*a* with distance measuring means 103, 104, 105. Employing inclinometers allows for the calculation of the absolute position of mining machine 1 in three-dimensional space. This may be desirable if the mining machine 1 is being operated within an inclined seam.

Given three sides of any triangle, the angles can be determined from cosine and sine theorems as follows:

$$\text{Cosine Theorem: } \cos\alpha = \frac{b^2 + c^2 - a^2}{2bc}$$

$$\text{Sine Theorem: } \sin\beta = \frac{b\sin\alpha}{a}$$

$$\gamma = 180^\circ - (\alpha + \beta),$$

where in the first triangle (MNO): a=MN, b=OM, c=ON, $\alpha = \measuredangle MON$, $\beta = \measuredangle MNO$, and $\gamma = \measuredangle OMN$; and in the second triangle (NOP): a=OP, b=NP, c=ON, $\alpha = \measuredangle ONP$, $\beta = \measuredangle NOP$, and $\gamma = \measuredangle OPN$.

The navigation procedure is as follows:

Step 1: Stabilize O and P with side jacks 8 and move M and N with advancing cylinders 12. OM changes to OM1, ON to ON1, and NP to NP1. MN and OP remain fixed.

Step 2: Stabilize M and N with secondary jacks 101 and calculate new coordinates of M and N by triangulation.

Step 3: Release side jacks 8 and move O and P with advancing cylinders 12. OM1 changes to OM2, ON1 to ON2, and NP1 to NP2. MN and OP remain fixed.

Step 4: Stabilize O and P and calculate new coordinates of O and P by triangulation.

Repeat steps 1 through 4.

The above process measures actual distance traveled, rather than estimating it. Thus it allows the user to calculate the instantaneous position of mining machine 1 to an accuracy not obtainable with known position measuring means for mining machines. This allows the user to calculate the actual azimuth of the mining machine, in turn allowing for maximum material extraction from the mine. Using the above process to move mining machine 1 a distance of 1500 feet, while employing commercially available measuring means, will result in a position calculation that is accurate within three inches (0.167% error). Furthermore, the lack of complex measuring devices makes the present invention more reliable and less expensive than known apparatus.

Distance measuring means 103, 104, and 105 can take many forms. In the preferred embodiment, rotary potentiometers are used. Cables are attached between the points M, N, O, and P. As points M and O move relative to points N and P, the cables modify the potentiometers. By comparing the measurements before and after the modifications, the potentiometers can measure the amount and direction of movement. Other possible embodiments for the measuring means 103, 104, and 105 comprise linear potentiometers, proximity sensors, lasers, ultrasonic equipment, infrared sensors, hydraulic or pneumatic cylinders, and other known distance measuring apparatus.

Referring to FIGS. 1, 2, and 22 through 25, an endless belt conveyer 17 is mounted in an intermediate module 6. Drive shaft 14 powers axles 13 through drives 16 and drive shaft 18 powers the conveyer 17 through drives 19. In order to add an intermediate module 6 to a conveying assembly 5, said intermediate module is advanced toward the conveying assembly 5. Cam 77 located on the bottom deck 33 of the platform 15 engages roller 75 and the raised portion 78 of the cam 77 raises roller 75 mounted on the hook 72. This causes the hook 72 to rotate around the pin 73 and clear the pin 76. The hook 72 then enters the fork 80 in the plate 71 of the coupling assembly 22. As the intermediate module 6 advances with the conveying assembly 5 toward the mine opening 2, roller 75 is disengaged from the cam 77 and hook 72, under the force of gravity, engages the pin 76, locking it within the fork 80. A spring can also be used to bias the position of hook 72. Stopper 74 holds the hook 72 in the lowermost position. While the coupling assemblies 22 engage intermediate modules 6 with one another, couplings 23 and 24 connect drive shafts 14 and 18. As can be seen from FIG. 25, couplings 23 and 24 together with flexible couplings 79 are capable of accommodating variable grades of the floor 2A in the mine opening 2. The rotation about the transverse axis between intermediate modules 6 occur around the pin 76, while the hook 72 rotates about the pin 73. A limited rotation about the longitudinal axis is allowed due to the clearance between the fork 80 and the pin 76.

To remove intermediate module 6 from the conveying assembly 5, the operation is reversed. As the conveying assembly 5 trams out of the mine opening 2, raised portion 78 of the cam 77 lifts roller 75 and rotates hook 72 away from pin 76. The disengaged intermediate module 6 continues tramming onto the bottom deck 33 while the rest of the conveying assembly 5 remains stationary, in order to separate the disengaged intermediate module from the conveying assembly.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A method of navigating a mining machine operatively connected to a conveying machine, independently of the relative position of a mine excavation, comprising:

bracing the conveying machine between side walls of a mine opening independently of the mining machine by a first set of braces fixedly mounted on the conveying machine;

bracing the mining machine between the side walls of said mine opening independently of said conveying machine by a second set of braces fixedly mounted on the mining machine;

determining a first relative position of the conveying machine and the mining machine by measuring at least three geometrical parameters of a general quadrilateral formed by two predetermined geometrical points fixed with respect to the mining machine and two predetermined geometrical points fixed with respect to the conveying machine;

releasing the mining machine;

moving the mining machine away from the conveying machine;

bracing the mining machine between the side walls of said mine opening independently of the conveying machine by said second set of braces;

determining a second relative position of the conveying machine and the mining machine by measuring at least three geometrical parameters of said general quadrilateral;

releasing the conveying machine; and moving the conveying machine toward the mining machine.

2. A method according to claim 1, wherein said determining of relative positions includes measuring at least two variable dimensions and one angle within said general quadrilateral.

3. A method according to claim 1, wherein said determining of said first and second relative positions includes measuring at least one variable dimension and two angles within said general quadrilateral.

4. A method according to claim 1, wherein said determining of said first and second relative positions includes measuring at least three angles within said general quadrilateral.

5. A method according to claim 1, wherein said determining of said first and second relative positions includes measuring at least three variable dimensions within said general quadrilateral.

6. An apparatus comprising:

a mining machine;

a conveying machine operatively connected to said mining machine;

a first set of braces fixedly mounted to said conveying machine a second set of braces fixedly mounted to said mining machine; and a measurer operatively coupled to measure at least three geometrical parameters of a general quadrilateral formed by two predetermined geometrical points fixed with respect to said mining machine and two predetermined geometrical points fixed with respect to said conveying machine.

7. An apparatus according to claim 6, wherein said measurer comprises a combination of linear and rotary potentiometers.

8. An apparatus according to claim 7, wherein said measurer comprises a plurality of rotary potentiometers.

9. An apparatus according to claim 7, wherein said measurer comprises a plurality of linear potentiometers.

10. An apparatus according to claim 7, wherein said measurer is an integral part of said conveying machine.

* * * * *